United States Patent [19]

Aoki et al.

[11] 4,031,642

[45] June 28, 1977

[54] AUTOMATIC CALENDAR

[75] Inventors: Motomu Aoki, Atsugi; Akira Ishikawa, Tokyo, both of Japan

[73] Assignee: Motomu Aoki, Japan

[22] Filed: Apr. 11, 1974

[21] Appl. No.: 460,182

[30] Foreign Application Priority Data

| | | |
|---|---|---|
| Apr. 14, 1973 | Japan | 48-42438 |
| Dec. 26, 1973 | Japan | 49-339 |
| Jan. 28, 1974 | Japan | 49-10963 |

[52] U.S. Cl. ..... 40/111; 58/125 C

[51] Int. Cl.[2] ..... G09D 3/06

[58] Field of Search ..... 40/111–115, 40/107, 77.4, 34, 112, 52 R; 58/4 R, 4 A, 125 C, 126 E

[56] References Cited

UNITED STATES PATENTS

| | | | |
|---|---|---|---|
| 1,282,992 | 10/1918 | Vicik, Jr. | 58/4 R |
| 2,343,969 | 3/1944 | Forbes | 40/111 |
| 2,636,339 | 4/1953 | Holzner | 58/125 C X |
| 3,177,645 | 4/1965 | Devanney | 58/125 C X |
| 3,274,717 | 9/1966 | Herr | 40/111 |
| 3,681,913 | 8/1972 | Solari | 40/107 X |

*Primary Examiner*—Hugh R. Chamblee
*Assistant Examiner*—John H. Wolff
*Attorney, Agent, or Firm*—Toren, McGeady and Stanger

[57] ABSTRACT

An automatic calendar is provided which permits a regular change in the display from the end of the month to the first day of the next month to be achieved without requiring adjustment over a prolonged period of time, by employing a unique arrangement of numerals providing a display of date. The calendar comprises a unit's day display member having an indication of numerals in the sequence of 0, 1, 1, 2, 3, 4, 5, 6, 7, 8 and 9 at an equal interval, and a tens' day display member having an indication of numerals in the sequence of 0, 1, 1, 2, 2 and 3 or a repeated sequence thereof.

5 Claims, 45 Drawing Figures

AUTOMATIC CALENDAR

BACKGROUND OF THE INVENTION

The invention relates to an automatic calender which eliminates the need for adjustment over a prolonged period of time. Calendar clocks are well known themselves since long, including both mechanical and electrical types. However, an automatic calendar which is compact and easily manoeuvrable without requiring adjustment over a prolonged period of time is not yet available. In a mechanical clock, a definite, regular circulation prevails in the carry from seconds digit to minute digit or from minute digit to hour digit, so that the construction and assembly of gear trains and carry propagation has been relatively simple. However, in the day mechanism section of the mechanical calendar, while a decimal carry system can be employed when progressing from 1st day to 31st day, there is an irregular carry at the end of the month, changing from 31st to 1st day. In order to provide a definite circulating operation for the carry which permits a change from 31st to 1st day, there have been various proposals including using a scale of 31 system for the dating mechanism of the calendar, using a technique in which the data proceeds from 31 to 32, 33... 39, 00, 01 and in which the intermediate days are skipped to make the next step from 31 to 01, or the use of a cam, lever, pin or the like to change the tens' day digit through the carry so that 1st day may be displayed. Except for the day digits, the arrangement for the gear train and carry propagation can be achieved in a relatively simple manner in a mechanical calendar mechanism since twelve months provide a carry to the year digit and there is a definite circulation in the year digit in a period of four years from one leap year to the next. Similarly, in an electrical calendar mechanism having an automated day display, there is a program available at the end of the month which has a period of four years or 1461 days from one leap year to the next. Thus, if it is possible to provide a regular operation in a simple manner when changing from 31st to 1st day when producing a carry to the month digit, there can be established, by incorporating cams or contacts together with gate or switching circuits, a progress over 1461 days whereby the change of dating from the end of the month to the first day of the next month can automatically be achieved, including such change at the end of a short month. However, the use of a scale of 31 system for the dating involves an increased number of numerals to be displayed to result in an enlarged mechanism. While a drum display is proposed to provide a compact structure for such mechanism, the resulting angular displacement per day becomes small, thus requiring a special arrangement for the carry propagation. While a decimal system provides a compact structure for the display of days, it involves difficulties with the irregular carry at the end of the month.

SUMMARY OF THE INVENTION

Therefore, it is an object of the invention to provide a compact and easily maneuverable automatic calendar which permits a regular change of dating at the end of the month bridging over to the first day of the next month to be achieved automatically without requiring adjustment over a prolonged period of time, by employing a unique arrangement of numerals displaying days which comprises a combination of unit's day display member having an indication of numerals in the sequence of 0,1,1,2, 3,4,5,6,7,8 and 9 at an equal interval thereon and a tens' day display member having an indication of numerals in the sequence of 0, 1, 1, 2, 2 and 3 or a repeated sequence thereof.

It is another object of the invention to provide an automatic calendar which permits the adjustment of the day digits or the year, month and day digits to be effected in a simple and reliable manner.

The above and other objects, features and advantages of the invention will become apparent from the following description taken together with the drawings.

DETAILED DESCRIPTION OF THE INVENTION

Figure 1:
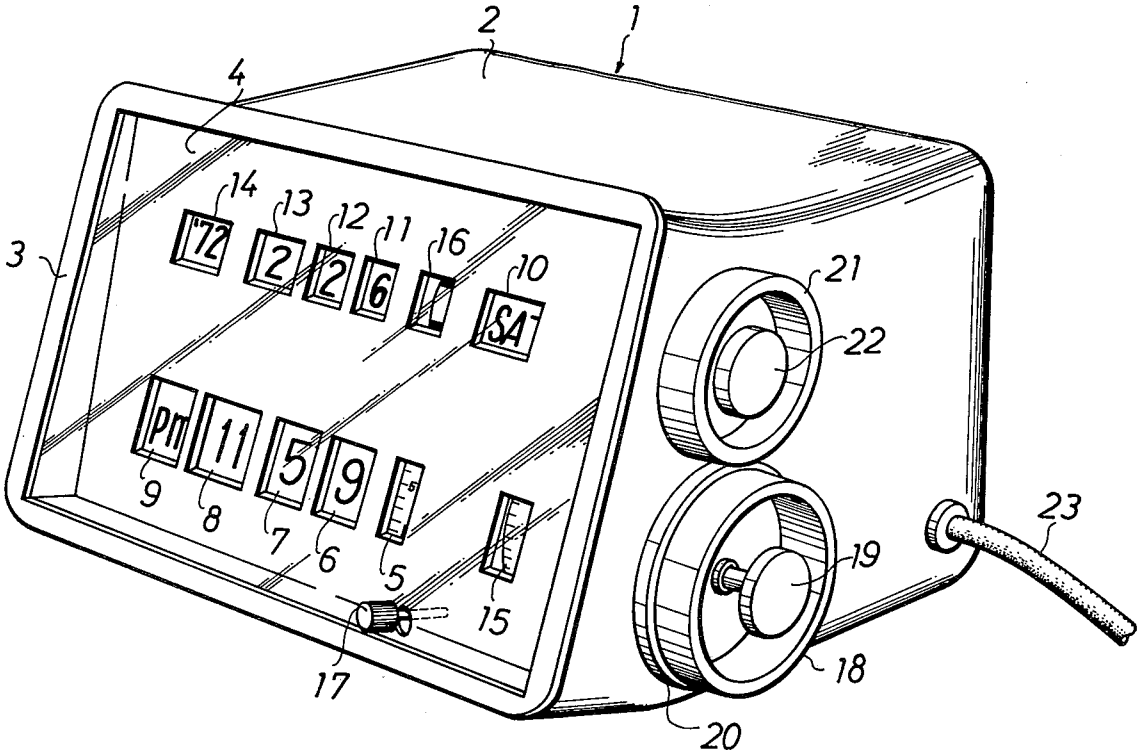
FIG. 1 is a perspective view illustrating the general appearance of the calendar clock incorporating the automatic calendar according to the invention.

Referring to FIG. 1, the calendar clock is generally shown at 1, and includes a casing 2 having a front frame 3 in which is mounted a face-plate 4 for the calendar clock 1. A plurality of display windows are formed in the faceplate 4 including seconds display window 5, unit's minute display window 6, tens' minute display window 7, hour display window 8, a.m.–p.m. display window 9, weekday display window 10, unit's day display window 11, tens' day display window 12, month display window 13, year display window 14 and a display window 15 for indicating an alarm time established. Additionally, an operation display window 16 as well as a knob 17 for operating an on-off switch for the alarm are provided. One side of the casing 2 is provided with a plurality of knobs, including unit's minute adjusting knob 18, a weekday adjusting knob 19, a knob 20 for establishing an alarm time, a unit's day adjusting knob 21 and a knob 22 for adjusting the year and month. A power supply cord 25 is also shown as connected with the apparatus through an aperture formed in this wall.

Figure 2:
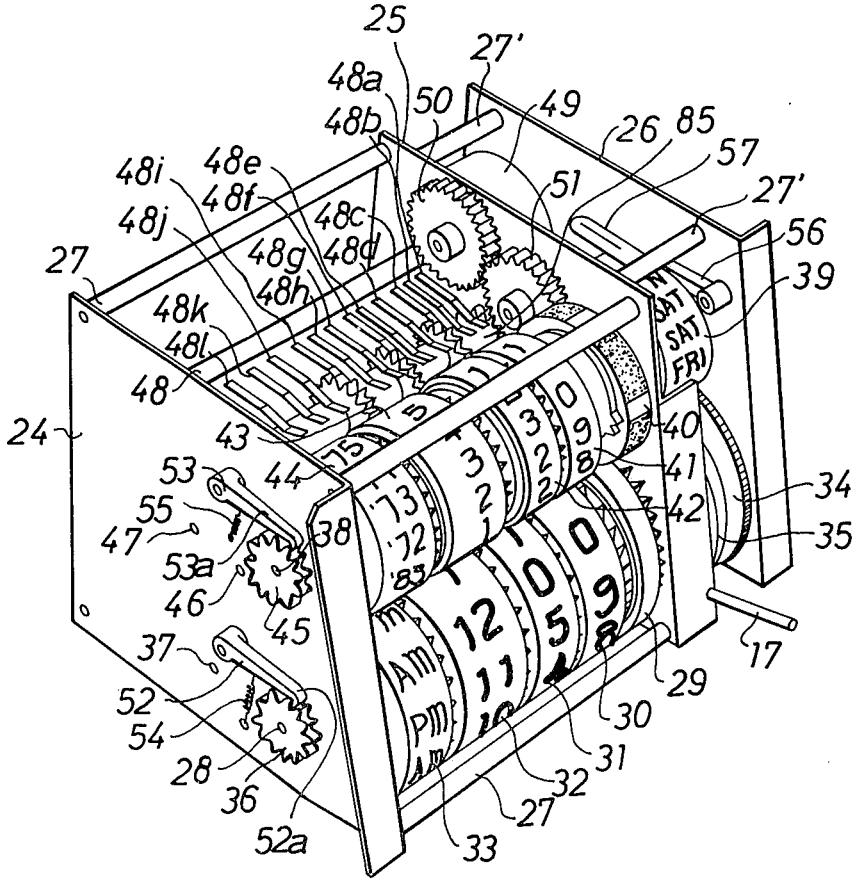
FIG. 2 is a perspective view of the calendar clock of FIG. 1, with the casing removed to show the interior.
Figure 3:
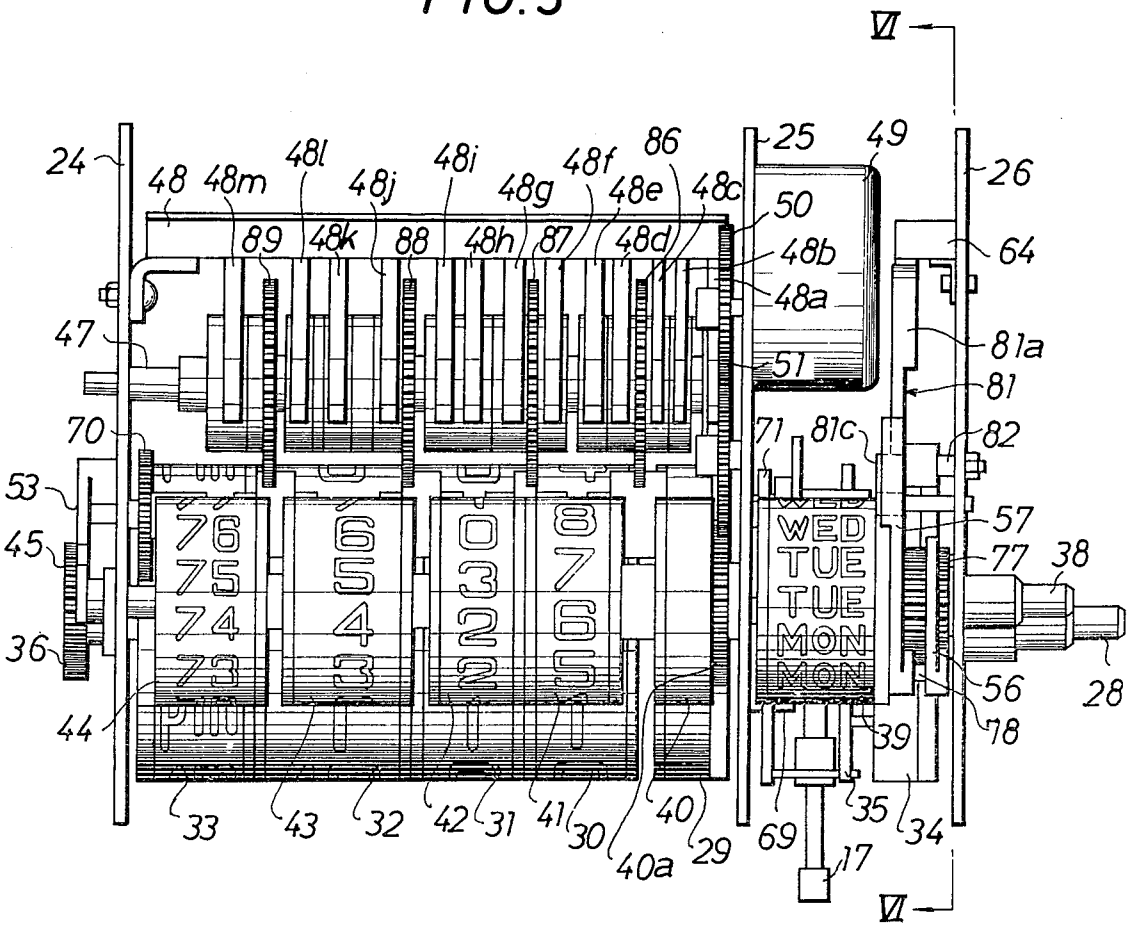
FIG. 3 is a plan view of the calendar clock shown in FIG. 2.
Figure 4:
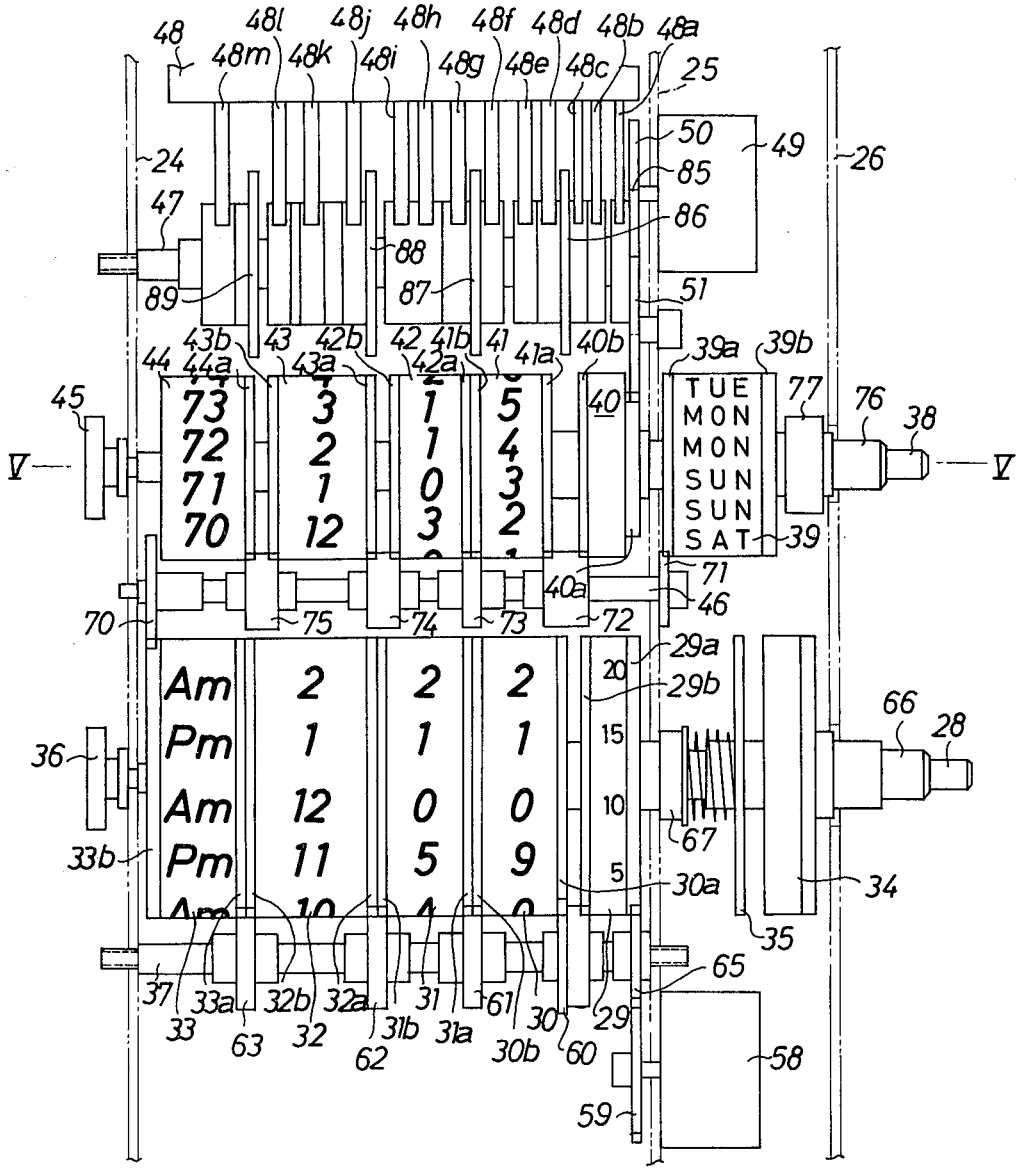
FIG. 4 is a similar view to FIG. 3, but showing the arrangement of a train of carry wheels.
Figure 5:
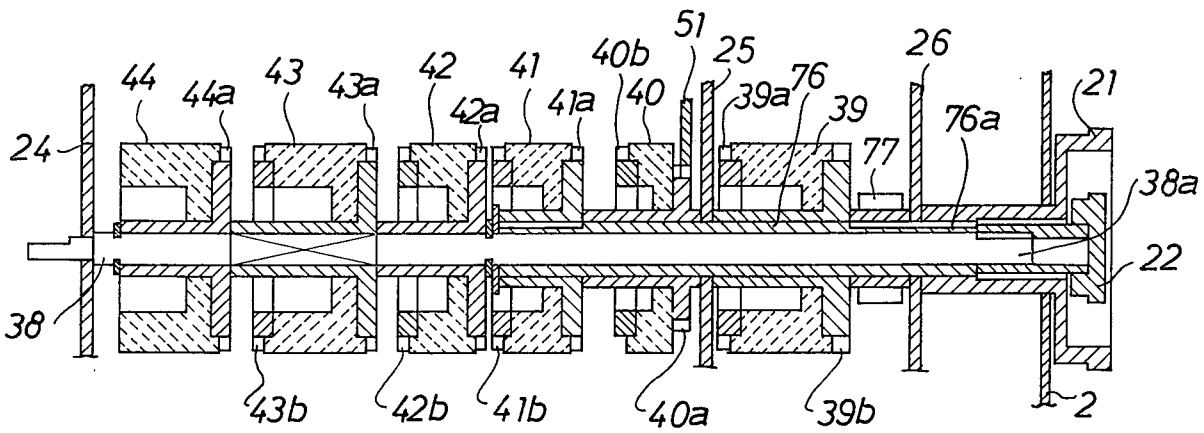
FIG. 5 is a cross section taken along the line V — V shown in FIG. 4.

Referring to FIGS. 2 to 6, side plates 24, 25, 26 are assembled together by means of pivots 27, 27' and serve supporting the internal components to be described later. A main shaft of the clock is shown at 28, and on the shaft are fitted a seconds display drum 29, a unit's minute display drum 30, a tens' minute display drum 31, an hour display drum 32, an a.m.–p.m. display drum 33, an alarm establishing drum 34 and an alarm operating gear 35. An indexing gear 36 for defining the position of the a.m.–p.m. display drum 33 is pivotally mounted on one axial end of the main shaft 28, while the unit's minute adjusting knob 18, the weekday adjusting knob 19 and the alarm time establishing knob 20 are fitted on the other axial end of the main shaft 28. A carry pinion shaft of the clock is shown at 37. A main shaft of the calendar is shown at 38 and fitted on this shaft are a weekday display drum 39, a date operating wheel 40, a unit's day display drum 41, a tens' day display drum 42, a month display drum 43 and an year display drum 44. A month indexing gear 45 for defining the position of the month display drum 43 is pivotally mounted on one axial end of the main shaft 38, while the unit's day adjusting knob 21 and the year and month adjusting knob 22 are fitted on the other axial end of the main shaft 38. A carry pinion shaft is for the calendar shown at 46, while a memory cam shaft is shown at 47. A memory switch assembly 48 includes a number of switches, including a keep switch **48*a*, a unit's day pass memory switch 48*b*, a detection switch 48*c* for the unit's day at the end of February of a common year, a detection switch 48*d* for the unit's day at the end of February of a leap year, a detection switch 48*e* for the end of a short month, a tens' day pass memory switch 48*f*, a detection switch 48*g* for the tens' day at the end of February of a common year, a detection switch 48*h* for the tens' day at the end of February of a leap year, a detection switch 48*i* for the tens' day at the end of a short month, a detection switch 48*j* for a short month, a detection switch 48*k* for February of a common year, a detection switch 48*l* for February of a leap year, and a detection switch 48*m* for a leap year, these switches serving a keep operation of the calendar as will be further described later. A drive motor 49 for the calendar is connected through a motor gear 50 and a relay gear 51 with the date operating wheel 40 for transmitting the rotation of the motor 49 thereto. A pair of locking levers 52 and 53 are pivotally mounted on the outside of the side plate 24 and have pawls 52*a* and 53*a* at their free end, which engage the indexing gear 36 defining the position of the a.m.–p.m. display drum 33 and the month indexing gear 45 defining the position of the month display drum 43, respectively. As shown in FIG. 2, the locking levers 52, 53 are urged by tension springs 54, 55 into meshing engagement with the indexing gears 36, 45, respectively, thereby locking these gears 36 and 45 against rotation. A lever 56 defines the position of the unit's day display drum 41. A numeral 57 represents a keep lever. A drive motor 58 for the clock is connected through a motor gear 59 and a group of pinion gears to be described later to rotate the hour display drum. A tens' minute carry pinion gear 61, an hour carry pinion gear 62 and an a.m.–p.m. changeover pinion gear 63 are rotatably mounted on the carry pinion shaft 37 of the clock which is supported between the side plates 24 and 25. Numeral 64 in FIG. 3 represents a calendar operating switch which will be described later, and numeral 69** represents an alarm switch.

A relay gear 65 which rotates by meshing engagement with the motor gear 59 that is fixedly mounted on the drive motor 58 of the clock meshes with a seconds feed gear **29*a* which is integral with the seconds display drum 29 so as to rotate the seconds display drum 29 by one revolution per minute. On its periphery, the seconds display drum 29 is provided with an indication of seconds displaying numerals from 0 to 59, and is also integrally provided with the unit's minute carry ratchet wheel 29*b* on its one lateral side so that during an interval the seconds displaying numeral appearing through the second display window 5 (see FIG. 1) changes from 55 to 0, the pawl of the ratchet wheel 29*b* meshes with the unit's minute carry pinion gear 60 to impart an intermittent rotation thereto while remaining inoperative during other time. The unit's minute carry pinion gear 60 is loosely fitted on the carry pinion shaft 37 at a position intermediate the seconds display drum 29 and the unit's minute display drum 30 for meshing engagement with the unit's minute carry ratchet wheel 29*b* and unit's minute feed gear 30*a* which is integrally provided on one side of the unit's minute display drum 30 in order to transmit an intermittent feed rotation therebetween. Specifically, the arrangement is such that the unit's minute display drum 30 is rotated by 36° in an interval during which the display of seconds on the seconds display drum 29 changes from 55 to 0. On its outer periphery, the unit's minute display drum 30 is provided with an indication of numerals indicating unit's minutes from 0 to 9 at an equal interval, and is also integrally provided with a tens' minute carry ratchet wheel 30*b* on its lateral side. During the time when the numeral indicating the unit's minute which appears through the unit's minute display window 6 (see FIG. 1) changes from 9 to 0, the pawl of the tens' minute carry ratchet wheel 30*b* meshes with the tens' minute carry pinion gear 61 to impart an intermittent rotation thereto, while remaining inoperative during other time. The tens' minute carry pinion gear 61 is loosely fitted on the carry pinion shaft 37 at a position intermediate the unit's minute display drum 30 and the tens' minute display drum 31 for meshing engagement with the tens' minute carry ratchet wheel 30*b* and a tens' minute feed gear 31*a* which is integral with the tens' minute display drum 31, thus rotating the tens' minute display drum 31 by 30° in an interval during which the numeral displayed by the unit's minute display drum 30 changes from 9 to 0. On its outer periphery, the tens' minute display drum 31 is provided with an indication of numerals 0, 1, 2, 3, 4, 5, 0, 1, 2, 3, 4, 5 at an equal interval, and is provided with an hour carry ratchet wheel 31*b* on its lateral side. In an interval during which the numerals displaying tens' minute which appears through the tens' minute display window 7 (see FIG. 1**) changes from 5 to 0, the pawl of the hour carry ratchet wheel 31 meshes with the hour carry pinion gear 62 to impart an intermittent rotation thereto while remaining inoperative during other time. The hour carry pinion gear 62 is loosely fitted on the carry pinion shaft 37 at a position intermediate the tens' minute display drum 31 and the hour display drum 32 for meshing engagement with the hour carry ratchet wheel 31*b* and an hour feed gear 32*a* which is integrally provided on the lateral side of the hour display drum 32, thus causing the hour display drum 32 to be rotated by 30° in an interval during which the numeral displayed by the tens' minute display drum 31 changes from 5 to 0. On its outer periphery, the hour display drum 32 is provided with an indication of numerals from 1 to 12 at an equal interval, and is also provided with half-day carry ratchet wheel 32*b* on its lateral side. In an interval during which the numeral displaying the hour which appears through the hour display window 8 (see FIG. 1) changes from 11 to 12, the pawl of the half-day carry ratchet wheel 32*b* meshes with the half-day feed pinion gear 63 to impart an intermittent rotation, but the ratchet wheel 32*b* has no other pawl which operates to impart such a rotation during other time intervals. The half-day feed pinion gear 63 is loosely fitted on the carry pinion shaft 37 at a position intermediate the hour display drum 32 and the a.m.-p.m. display drum 33 for meshing engagement with the half-day carry ratchet wheel 32*b* and a half-day feed gear 33*a* which is integrally mounted on the lateral side of the a.m.-p.m. display drum 33 so as to cause a rotation of the display drum 33 through a definite angle which is necessary to interchange the letters a.m. and p.m., which are indicated over an equal length of the outer periphery of the display drum 33. On its outer periphery, the a.m. - p.m. display drum 33 carries the letters a.m. and p.m. (or different colour indications) alternately and is coupled, through a clutch, with a weekday feed gear 33*b* located on its lateral side for integral rotation. The weekday feed gear 33*b* is fixedly mounted on the main shaft 28 of the clock. The weekday feed gear 33*b* can be rotated alone from the exterior through a definite angular increment, by applying a manual rotation to the weekday adjusting knob 19 (see FIG. 1) located outside the casing 2 and which is secured to the end of the main shaft 28 of the clock, to thereby disengage the clutch which couples the a.m. - p.m. display drum 33 with the weekday feed gear 33*b*.

The a.m. - p.m. display drum 33, the hour display drum 32 and the tens' minute display drum 31 are loosely fitted on the main shaft 28 of the clock, while the unit's minute display drum 30 is fixedly mounted on a hollow shaft 66 and is loosely fitted on the main shaft 28 of the clock for rotation thereon through the hollow shaft 66, together with an alarm drive pinion gear 67 integral with the hollow shaft 66 as well as the unit's minute adjusting knob 18 (see FIG. 1) secured to the end of the hollow shaft 66. The seconds display drum 29 and the alarm time establishing knob 20 (see FIG. 1), which is integral with the alarm operating gear 35 and the alarm time establishing drum 34, are loosely fitted on the hollow shaft 66 for rotation thereon. When the clock is to be adjusted, the alarm time establishing knob 20 is rotated to rotate the alarm time establishing drum 34 which loosely fits on the hollow shaft 66, and the unit's minute adjusting knob 18 is rotated the unit's minute display drum 30 secured to the hollow shaft 66 which is loosely fitted on the main shaft 28 of the clock, and the weekday adjusting knob 19 is rotated to rotate the main shaft 28 of the clock to thereby rotate the weekday feed gear 33*b*.

Figure 7:
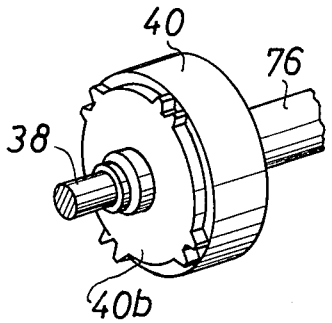
FIG. 7 is a perspective of the date operating wheel.
Figure 8:
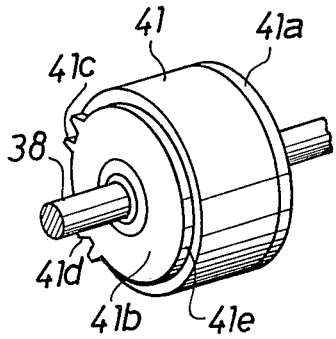
FIG. 8 is a perspective view of the unit's day display drum.
Figure 9:
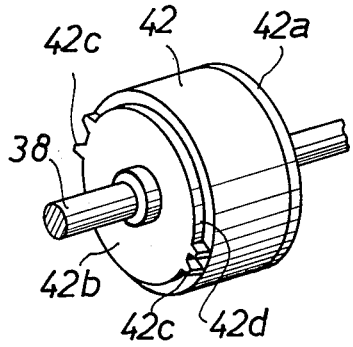
FIG. 9 is a perspective view of the tens' day display drum.
Figure 10:
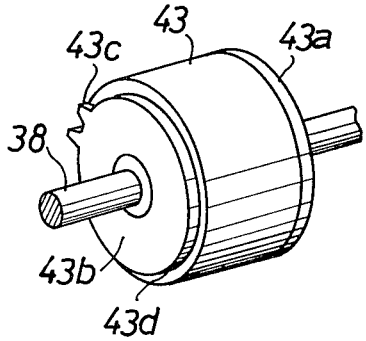
FIG. 10 is a perspective view of the month display drum.

A weekday feed relay gear 70 is secured to the carry pinion shaft 46 of the calendar, and rotates by meshing engagement with the weekday feed gear 33*b* which rotates integrally with the a.m. - p.m. display drum 33. A weekday feed output gear 71 is secured to the carry pinion shaft 46 of the calendar, and rotates by meshing engagement with a weekday rotating gear 39*a* which is integrally provided on one lateral side of the weekday display drum 39. The gear ratio is chosen so that the weekday display drum 39 rotates in increments of 1/14 revolution in response to an intermittent rotation of the weekday feed gear 33*b*. Thus, starting with the rotation of the seconds display drum 29 in the clock, the drums associated with the unit's minute, tens'minute and the hour digits are supplied with a carry through the carry pinions, and in an interval during which the combination of numerals/displayed by the drums, as viewed through the display windows, change from 11 o'clock 59 minutes to 12 o'clock 00 minutes, a carry is propagated to the a.m. - p.m. display drum 33 to change a display thereof. Simultaneously, the weekday display drum 39 rotates through 1/14 revolution. On its outer periphery, the weekday display drum 39 carries fourteen combinations of letters SUN, SUN, MON, MON, TUE, TUE, WED, WED, THU, THU, FRI, FRI, SAT, SAT, and the arrangement is such that when the a.m. -p.m. display drum 33 provides a display of a.m., the first indication of weekday from each pair appears through the weekday display window 10 (see FIG. 1). When there occurs a change in the display from a.m. to p.m., the display drum 33 rotates through 1/14 revolution to cause the second indication of the weekday from each pair to be displayed. For example, assuming that a change occurs from a.m. to p.m. when the initial indication of TUE is displayed, the second indication of TUE becomes to be displayed, and subsequently when the display changes from p.m. to a.m., the display of weekday changes to the initial indication of WED. The weekday display drum 29 is integrally provided with a date operating cam 39*b* on its lateral side, the cam operating to rotate this drum. The relay gear 51 which rotates by meshing engagement with the motor gear 50 fixedly mounted on the drive motor 49 of the calendar meshes with an operating gear 40*a* secured to the lateral side of the date operating wheel 40 as well as with a keep cam gear 85 (see FIG. 24) to be described later, imparting rotation thereto. On its lateral side, the date operating wheel 40 (see FIG. 7) is provided integrally with an intermittent gear 40*b* having teeth separated by hiatus of an equal length, which gear 40*b* meshes with one day feed pinion gear 72. The toothed portion of the gear 40*b* operates to impart an intermittent rotation to the one day feed pinion gear 72, while the hiatus portion does not serve transmission of such rotation. The one day feed pinion gear 72 is loosely fitted on the carry pinion shaft 46 of the calendar at a position intermediate the date operating wheel 40 and the unit's day display drum 41 for meshing engagement with the intermittent gear 40*b* and one day feed gear 41*a* which is secured to the lateral side of the unit's day display drum 41 to impart an intermittent rotation thereto such that the unit's day display drum 41 is intermittently rotated through 1/11 revolution by one intermittent motion. On its outer periphery, the unit's day display drum 41 is provided with an indication of numerals displaying the unit's digits of day in the sequence of 0, 1, 1,2, 3, 4, 5, 6, 7, 8 and 9 so that these figures appear in turn in this sequence through the unit's day display window 11 (see FIG. 1) at each end of the intermittent rotation. As shown in FIG. 8, the unit's day display drum 41 is integrally provided with tens' feed, intermittent gear 41*b* on its lateral side, and the gear 41*b* is provided with two toothed portions 41*c* and 41*d* which are separated by a hiatus 41*e* such that twice during the rotation of the display drum 41 which correspond to the intervals during which the numeral displaying the unit's day which appears through the unit's day display window 11 (FIG. 1) changes from 9 to 0 and from 1 to 1, each of the toothed portions with ten day feed pinion gear 73 to impart a rotation thereto, while it does not mesh with the feed pinion gear 73 to rotate it because of the hiatus 41*e* during a change between other figures of the unit's day. The ten day feed pinion gear 73 is loosely fitted on the carry pinion shaft 46 at a position intermediate the unit's day display drum 41 and the tens' day display drum 42 for meshing engagement with the two toothed portions 41*c* and 41*d* of the tens' feed intermittent gear 41*b* and also with a tens' feed gear 42*a* which is integrally provided on the lateral side of the tens' day display drum 42 so as to cause a rotation of the tens' day display drum 42 through 30° at two times when the numeral displayed by the drum 41 changes from 9 to 0 and from 1 to 1. By extending selected teeth 73*a* (see FIG. 11) of the ten day feed pinion gear 73 which correspond to every second or third tooth thereof, so that the peripheral curved surface of the unit's day display drum 41 wedges into the space between two of the extended teeth 73*a*, a free rotation of the ten day feed pinion gear 73 is prevented for other changes of numerals displaying the unit's day. However, when the numeral displayed by the unit's day display drum 73 changes from 9 to 0 and from 1 to 1, the extended teeth 73*a* of the gear fall into a pair of recesses 41*f* and 41*g* (see FIG. 11) formed in the peripheral surface of the unit's day display drum 41 to release the constraint imposed on the rotation of the ten day feed pinion gear 73, thus enabling it to rotate. On its outer periphery, the tens' day display drum 42 is provided with an indication of numerals in the sequence of 0, 1, 1, 2, 2, 3, 0, 1, 1, 2, 2 and 3 at an equal interval so as to present the numerals in the sequence of 0, 1, 1, 2, 2 and 3 within the tens' day display window 12 (see FIG. 1) at each end of rotation through 30°. The arrangement is such that when 0 is displayed within the unit's day display window 11, 3 is displayed within the tens's day display window 12, thus providing a display of 30. As shown in FIG. 9, the tens' day display drum 42 is integrally provided with a month feed intermittent gear 42*b* on its lateral side, which is constructed such that during the time the numeral displaying the tens' day which appears through the tens' day display window 12 changes from 3 to 0, a toothed portion 42*c* of the gear 42 meshes with a month feed pinion gear 74 to impart the rotation thereto, while it does not mesh with the pinion gear 74 as a result of its hiatus 42*d* coming opposite thereto when the display of the tens' day changes between other numerals. In customary notation of months and days employed in the U.S. and Japan, the month feed pinion gear 74 is loosely fitted on the carry pinion shaft 46 at a position intermediate the tens' day display drum 42 and the month display drum 43 for meshing engagement with the toothed portion 42*c* of the month feed intermittent gear 42*b* and a month feed gear 43*a* integrally formed on the lateral side of the month display drum 43 so as to cause a rotation of the month display drum 43 through 30° in an interval when the numeral displayed by the tens' day display drum 42 changes from 3 to 0 within the tens' day display window 12. At other time, the month feed pinion gear 74 is not rotated. According to the notation of month and days employed in Europe in which the display is in the sequence of day initially and then month, some means must be provided to have a meshing engagement between the month feed pinion gear 74 and the toothed portion 42*c* of the month feed intermittent gear 42*b* associated with the tens' day display drum 41 so that the rotation is transmitted through a separate relay gear or the like to the month feed gear 43*a* associated with the month display drum 43. On its outer periphery, the month display drum 43 is provided with an indication of numerals from 1 to 12 at an equal interval so that it presents numerals in the sequence of 1, 2, 3, 4, 5, 6, 7, 8, 9, 10, 11 and 12 within the month display window 13 (see FIG. 1) at each end of rotation through 30°. As shown in FIG. 10, the month display drum 43 is integrally provided on its lateral side with a year feed intermittent gear 43*b* so that a toothed portion 43*c* of the gear 43*b* meshes with a year feed pinion gear 75 to impart a rotation thereto in an interval when the numeral displayed within the month display window 13 changes from 12 to 1. At portions of the intermittent gear 43*b* which correspond to other change of month displaying numerals, it is formed with a hiatus 43*d*, which prevents its meshing engagement with the year feed pinion gear 75. In the chronological notation employed in Japan, the year feed pinion gear 75 is loosely fitted on the carry pinion shaft 46 at a position intermediate the month display drum 43 and the year display drum 44 for meshing engagement with the toothed portion 43*c* of the year feed intermittent gear 43*b* and with a year feed gear 44*a* which is provided integrally on the lateral side of the year display drum 44 so as to cause a rotation of the year display drum 44 through an angle which is required to advance the display by one year during the time when the numeral displayed by the month display drum 43 within the month display window 13 changes from 12 to 1. By extending selected teeth of the year feed pinion gear 75 which correspond to every second or third teeth so as to abut against the peripheral surface wedges into the space between two of the extended teeth in the similar manner as described previously in connection with the ten day feed pinion gear 73, a free rotation of the year feed pinion gear 75 is blocked for other changes of the month displaying numerals. When the numeral displayed by the month display drum 43 changes from 12 to 1, the extended teeth of the year feed pinion gear 75 fall into recesses formed in the peripheral surface of the month display drum 43 to release the constraint imposed upon the rotation of the year feed pinion gear 75, thereby enabling it to rotate. In the notation of date according to the practice in the U.S. in which the date is given in the sequence of month, day and year, a different arrangement of display drums is required. Some means must be provided to have a meshing engagement of the year feed pinion gear 75 with the toothed portion 43*c* of the year feed intermittent gear 43*b* associated with the month display drum 43 and to transmit the rotation through a separate relay gear or the like to the year feed gear 44*a* associated with the year display drum 44. The display of year provided on the outer periphery of the year display drum 44 may be either according to the chronological era adopted in Japan or to the Christian Era or by a scheme in which the years from one leap year to the next is indicated in terms of characters or colors. Because the period of leap years in the calendar year is four years, the display of years provided on the outer periphery of the year display drum 44 must use divisions into a multiple of 4, namely, 4 divisions, 8 divisions, 12 divisions, 16 divisions 20 divisions or the like, any of which may be employed. In the present embodiment, the display of years includes twelve years from 1972 to 1983 of the Christion Era, which are given as '72, '73 . . . '83. However, it is also possible to provide a decimal representation as will be further described later.

Figure 6:
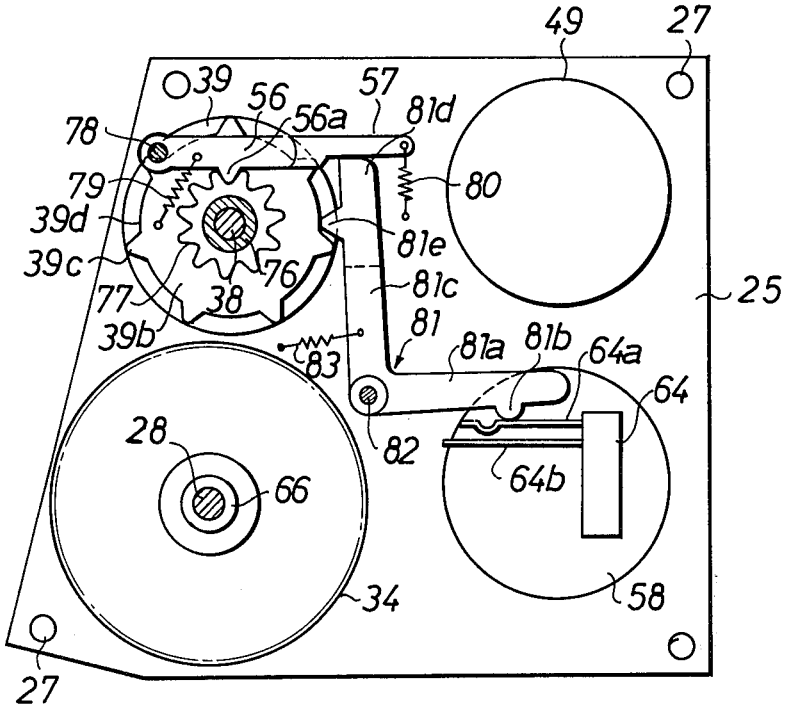
FIG. 6 is a front view, as viewed along the line VI — VI shown in FIG. 3.

The month display drum 43 is fixedly mounted on the main shaft 38 of the calendar, and can be freely rotated for the purpose of adjusting the year and month by applying a manual rotation to the year and month adjusting knob 22 (see FIG. 1) located outside the casing and secured to the end 38*a* of the main shaft 38. In order to permit a free adjustment of the year and month in this manner, the month feed pinion gear 74 is not provided with intermittent, extended teeth which prevent the rotation. The month indexing gear 45 is secured to the end of the main shaft 38 of the calendar in order to restrict the free rotation of the month feed pinion gear 74 and the month display drum 43 to a definite angle. The month indexing gear 45 has twelve teeth which correspond to twelve months, and the teeth have a suitable angle of inclination. The month indexing gear is constrained from free rotation by the pawl 53*a* of the month locking lever 53 under the action of the tension spring 55 (see FIG. 2), but can rotate when the month display drum 43 rotates, moving up the pawl 53*a* against the action of the spring and subsequently being locked again by the pawl when the rotative force is no longer transmitted thereto. In this manner, it operates to index the position of the month display drum 43 so that a proper numeral is presented within the month display window 13. It also permits a carry propagation or an adjustment of year and month to be effected in an easy manner. The year display drum 44 and the tens' day display drum 42 are loosely fitted on the main shaft 38 of the calendar for rotation. The unit's day display drum 41 is fixedly mounted on a hollow shaft 76, and is loosely fitted for rotation on the main shaft 38 through the hollow shaft 76, together with a unit's day indexing gear 77 secured to the hollow shaft 76 and the unit's day adjusting knob 21 which is secured to the end 76a of the hollow shaft 76 and located outside the casing 2. The unit's day indexing gear 77 has eleven teeth corresponding to the number of numerals displayed on the unit's day, as shown in FIG. 6, and is constrained from free rotation by the cooperative engagement, with the space between the teeth, of a pawl 56*a* of a day locking lever 56 which is pivotally mounted at 78 on the side plate 26 and urged by a tension spring 79 to rotate clockwise and also of a pawl 57*a* (see FIG. 19) of a keep lever 57 which is similarly pivotally mounted at 78 and urged by a tension spring 80 to rotate clockwise, as viewed in this FIG. However, when the unit's day display drum 41 rotates, the unit's day indexing gear 77 can rotate, moving up the pawls 56*a* and 57*a* of the locking lever 56 and the keep lever 57, respectively, and is locked again by these pawls under the action of the springs subsequent to the termination of its rotation, thereby properly indexing the position of the unit's day display drum 41 so that the numeral displayed thereby is properly presented within the unit's day display window 11. This permits a carry propagation and an adjustment of days to be effected in a ready manner with the aid of the unit's day adjusting knob 21. The date operating wheel 40 and the weekday display drum 39 are loosely fitted on the hollow shaft 76 for rotation.

It should be understood that the mounting of the group of display drums represents only one example, and that the unit's day display drum 41 may be fixedly mounted on the main shaft 38 of the calendar and the unit's day adjusting knob 21 may be secured to the end of the main 38 for the purpose of adjusting days.

Figure 11:
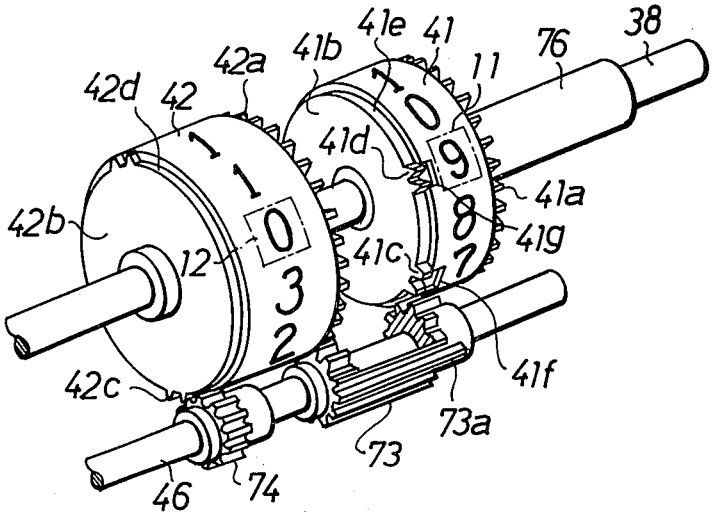
FIGS. 11 to 18 are perspective views of a combination of the unit's day display drum and the tens' day display drum progressing through consecutive days.
Figure 12:
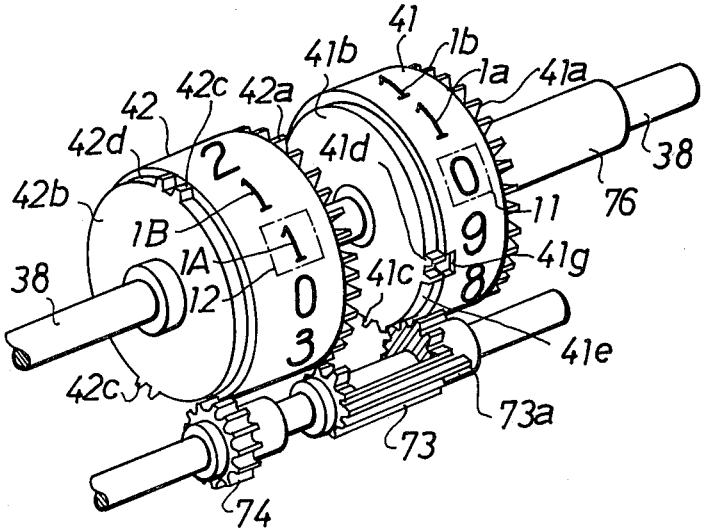
Figure 13:
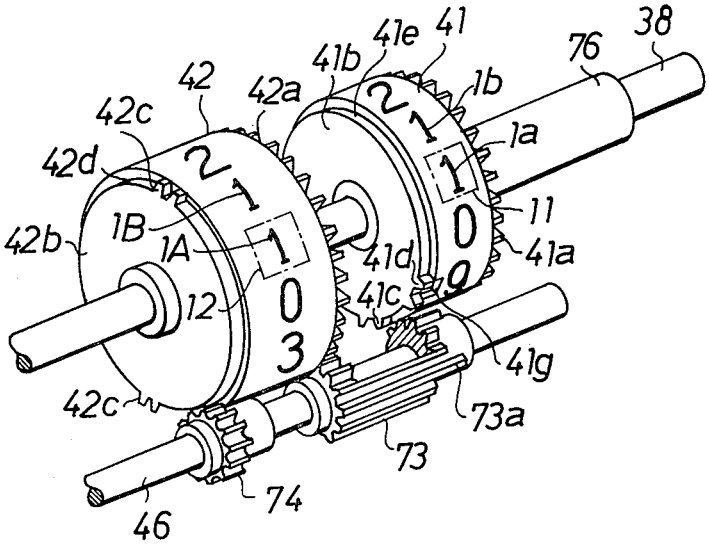
Figure 14:
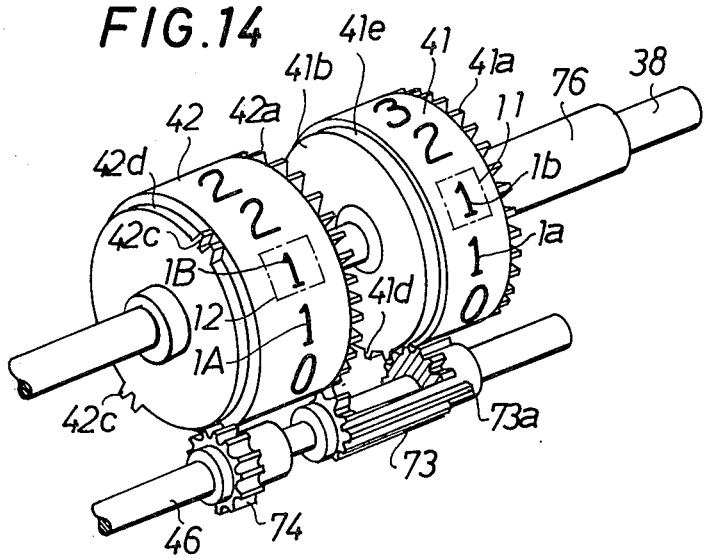
Figure 15:
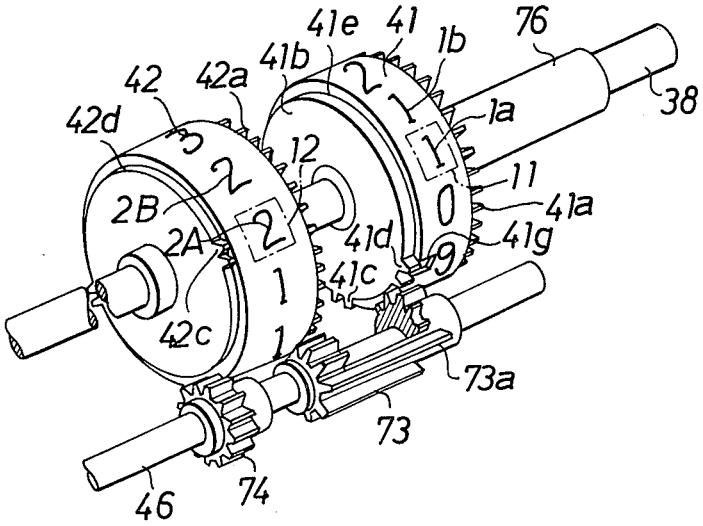
Figure 16:
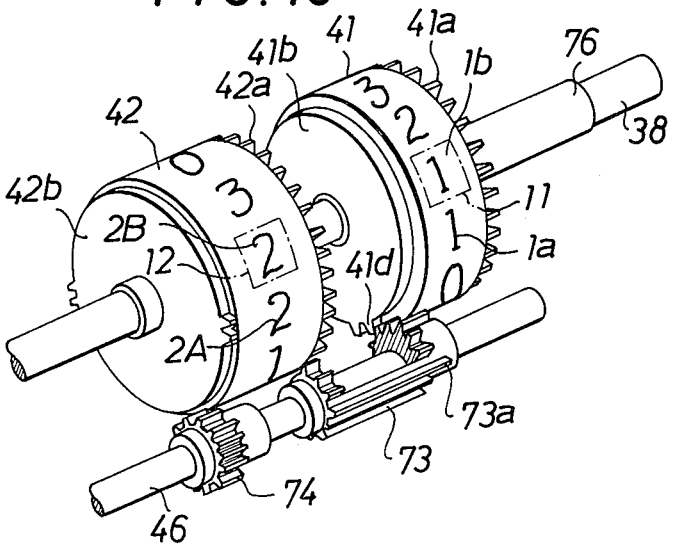
Figure 17:
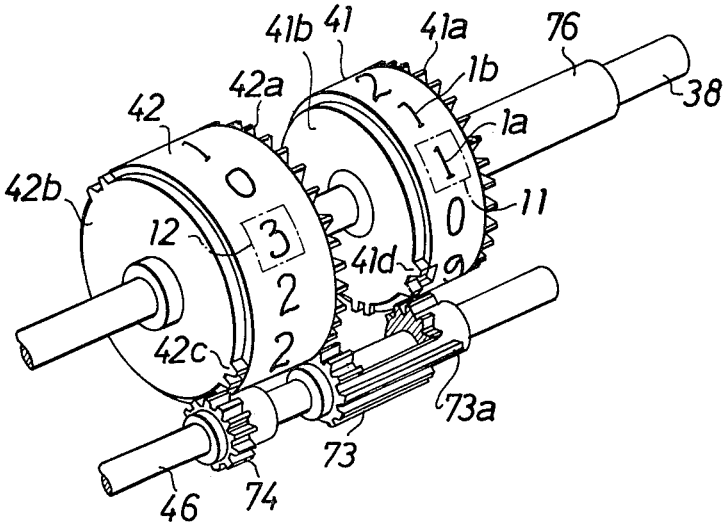
Figure 18:
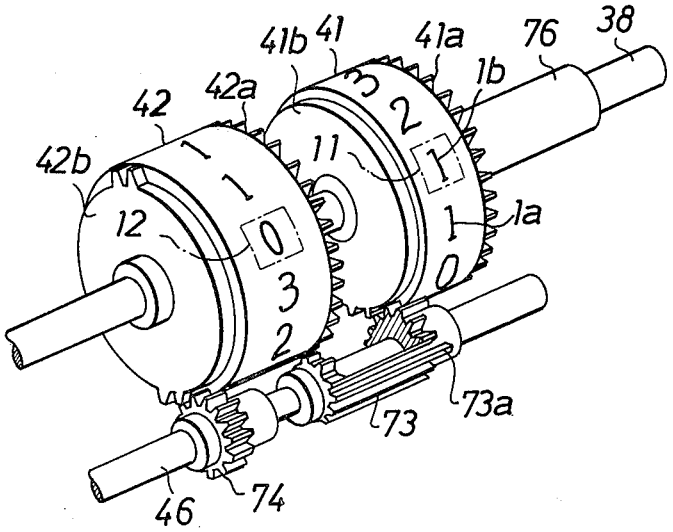

The progress of a display of days provided by a combination of the unit's day display drum 41 and the tens' day display drum 42 will be described more fully with reference to FIGS. 11 to 18. Under the condition depicted in FIG. 11, 0 is presented within the tens' day display window 12 and 9 is presented within the unit's day display window 11, thus displaying 09 or 9th day. Under this conditions, the toothed portion 41*c* located on the side of the unit's day display drum 41 is at rest at a position just to mesh with the ten day feed pinion gear 73, and as the unit's day display drum 41 commences to rotate, the toothed portion 41*c* moves into meshing engagement with the ten day feed pinion gear 73 whereby the unit's day display drum 41 and the tens' day display drum 42 rotate together through the ten day feed pinion gear 73, thus performing a carry operation. The end of such rotation is indicated in FIG. 12 in which the toothed portion 41*c* of the tens' feed intermittent gear 41*b* is disengaged from the ten day feed pinion gear 73, and thus is positioned to be incapable of transmitting rotation. The outer periphery of the unit's day display drum 41 moves into a position in which it wedges into the space between two of the extended teeth 73*a* of the ten day feed pinion gear 73 to constrain its free rotation. The display numeral 1 (1A) indicated on the outer periphery of the tens' day display drum 42 is presented within the tens' day display window 12 and 0 is presented within the unit's day display window 11, thus displaying 10 or 10th day. When the unit's day display drum 41 commences to rotate from this condition, the hiatus 41 in the tens' feed intermittent gear 41*b* faces the ten day feed pinion gear 73, but because no meshing tooth is present, the ten day feed pinion gear 73 does not rotate while the unit's day display drum 41 rotates, thus allowing the unit's day display drum 41 to rotate alone until the condition depicted in FIG. 13 is reached. The display numeral 1 (1A) on the tens' day display drum 42 is presented within the tens' day display window 12 and the display numer 1 (1*a*) on the unit's day display drum 41 is presented within the unit's day display window 11, thus displaying 11 or 11th day. Under this condition, the toothed portion 41*d* of the ten day feed intermittent gear 41*b* located on the lateral side of the unit's day display drum 41 is at rest at a position just prior to meshing engagement with the ten day feed pinion gear 73. As the unit's day display drum 41 commenses to rotate, the toothed portion 41*d* moves into meshing engagement with the ten day feed pinion gear 73, whereby the extended teeth 73*a* of the ten day feed pinion gear 73 fall into the recess 41*g* formed in the peripheral surface of the unit's day display drum 41 to release the ten day feed pinion gear 73 from constraint imposed thereon, thus allowing its meshing engagement with the toothed portion 41*d* to transmit the rotation of the unit's day display drum 41 to the tens' day display drum 42 and thus performing a carry operation. At the termination of such rotation, the assembly assumes the position shown in FIG. 14 in which the toothed portion 41*d* of the tens' feed intermittent gear 41*b* is disengaged from the ten day feed pinion gear 73 and is incapable of transmitting rotation. Two of the extended teeth 73*a* of the ten day feed pinion gear 73 bear against the outer peripheral surface of the unit's day display drum 41 to lock the ten day feed pinion gear 73 against free rotation. The display numeral 1 (1B) is presented within the tens' day display window 12 and the display numeral 1 (1*b*) is presented within the unit's day display window 11, thus displaying 11 or 11th day again. From 11th day displayed by the display numeral 1 (1B) on the tens' day display drum 42 and the display numeral 1 (1*b*) on the unit's day display drum 41 to 19th day, no carry operation is effected, and only the unit's day display drum 41 rotates while the ten day feed pinion gear 73 is being locked. When the unit's day display drum 41 commences its rotation from the state indicating 19th day in which the displaying numeral 1 (1B) is presented within the tens' day display window 12 and the display numeral 9 is presented within the unit's day display window, a carry operation takes place to present the display numeral 2 (2A) within the tens' day display drum 42 and to present the display numeral 0 on the unit's day display drum 41 within the unit's day display window 11, thus indicating 20th day. A further rotation of the unit's day display drum 41 by an amount corresponding to one day causes the display numeral 2 (2A) to be presented within the tens' day display window 12 and causes the displaying numeral 1 (1*a*) to be presented within the unit's day display window 11 to indicate 21st day, as shown in FIG. 15. An additional rotation of the unit's day display drum 41 by an amount corresponding to one day causes another carry operation to take place to assume the positions shown in FIG. 16. Thus 21st day is again displayed by the displaying numeral 2 (2B) presented within the tens' day display window 12 and the displaying numeral 1 (1*b*) presented within the unit's day display window 11. From 21st to 29th day indicated by the display numerals presented within the tens' and unit's day display drums 42 and 41, only the unit's day display drum 41 continues to rotate without accompanying a carry operation. When the unit's day display drum 41 rotates through an angle corresponding to one day from the state in which 29th day is indicated, a carry operation takes place again to display 30th day. Further rotation of the unit's day display drum 41 by an amount corresponding to one day causes the displaying numeral 3 to be presented within the tens' day display window 12 and the displaying numeral 1 (1*a*) to be presented within the unit's day display window 11 to indicate 31st as shown in FIG. 17. At this time, the toothed portion 41*d* of the tens' day feed gear 41*b* located on the lateral side of the unit's day display drum 41 is at rest at a position immediately preceding the meshing engagement with the tens' day carry pinion gear 73, and the toothed portion 42*c* of the month feed gear 42*b* located on the lateral side of the tens' day display drum 42 is also at rest at a position immediately preceding the meshing engagement with the month feed pinion gear 74. As the unit's day display drum 41 rotates through an amount corresponding to one day from such state, a carry operation takes place whereby the rotation of the unit's day display drum 41 is transmitted through the ten day feed pinion gear 73 to the tens' day display drum 42, and the toothed portion 42*c* of the month feed intermittent gear 42*b* meshes with the month carry pinion gear 74 to provide a carry operation for the month and day. At the end of the carry operation for the month and day, the parts assume the position shown in FIG. 18, indicating 1st day by the numeral 0 presented within the tens' day display window 12 and the display numeral 1 (1*b*) presented within the unit's day display window 11. No carry operation occurs during the interval when the numerals presented within the tens' day display drum 42 and the unit's day display drum 41 changes from 01 to 09, and only the unit's day display drum 41 rotates day by day. When 9th day is reached, the carry operation mentioned above is repeated to provide a display of 10th day.

The circulation of the day display achieved by the carry operation during one month occurs as follows: 01 → 02 → 03 → 04 → 05 → 06 → 07 → 08 → 09 → (carry operation) → 10 → 11 → (carry operation) → 11 → 12 → 13 → 14 → 15 → 16 → 17 → 18 → 19 → (carry operation) → 20 → 21 → (carry operation) → 21 → 22 → 23 → 24 → 25 → 26 → 27 → 28 → 29 → (carry operation) → 30 → 31 → (carry operation for month and day) → 01. In this manner, a circulating operation takes place in 33 days for one month. However, a cam memory functions to pass one of overlapping 11th and 21st days to provide a display of 31 days. The unit's day display drum 41 rotates in an angular increment of 360°/11 so that the displaying numerals 0, 1, 1, 2, 3, 4, 5, 6, 7, 8 and 9 are presented at an equal interval. The display numerals on the tens' day display drum 42 comprise a circulation of numerals 0, 1, 1, 2, 2 and 3. In other words, a combination of display by the both drums 41 and 42 starts from 30 (30th day).

Figure 19:
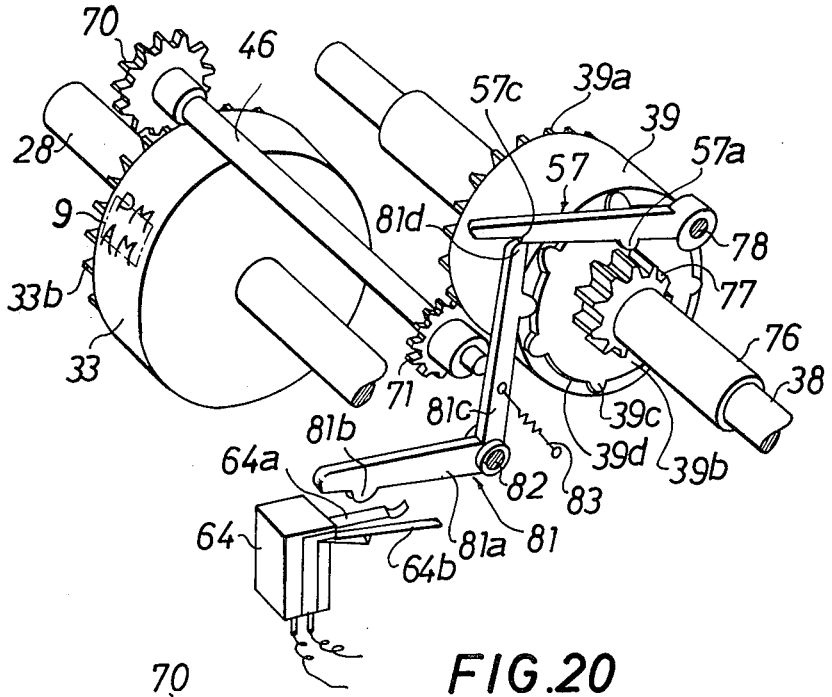
FIGS. 19 to 23 are views illustrating the starting of the operation of the calendar.
Figure 20:
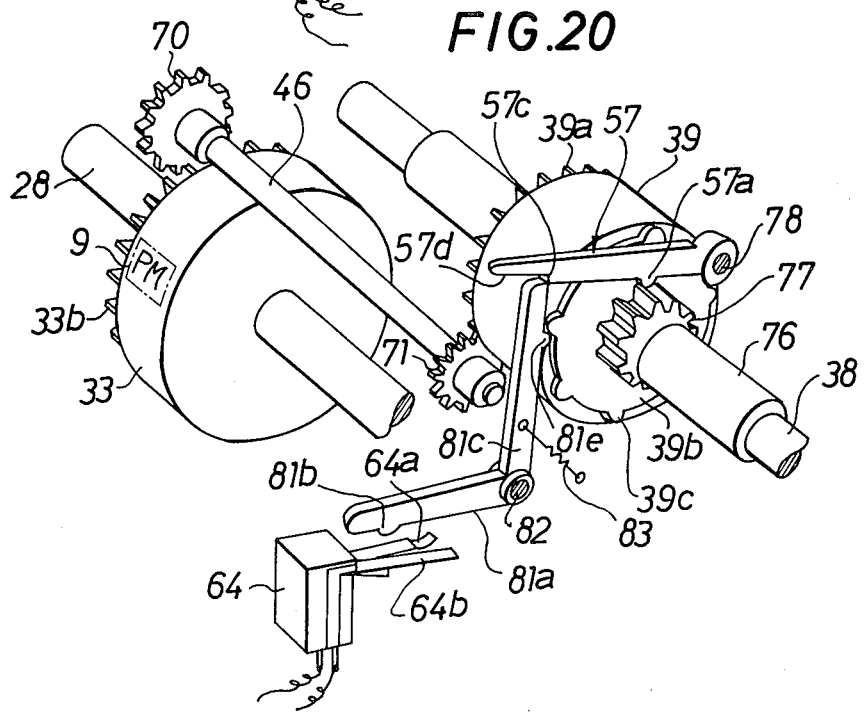
Figure 21:
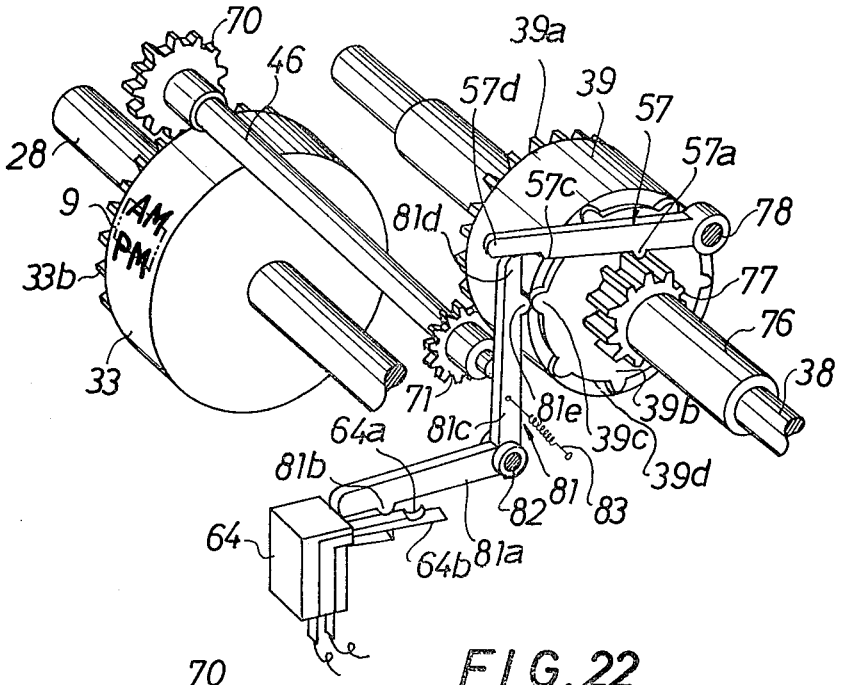
Figure 22:
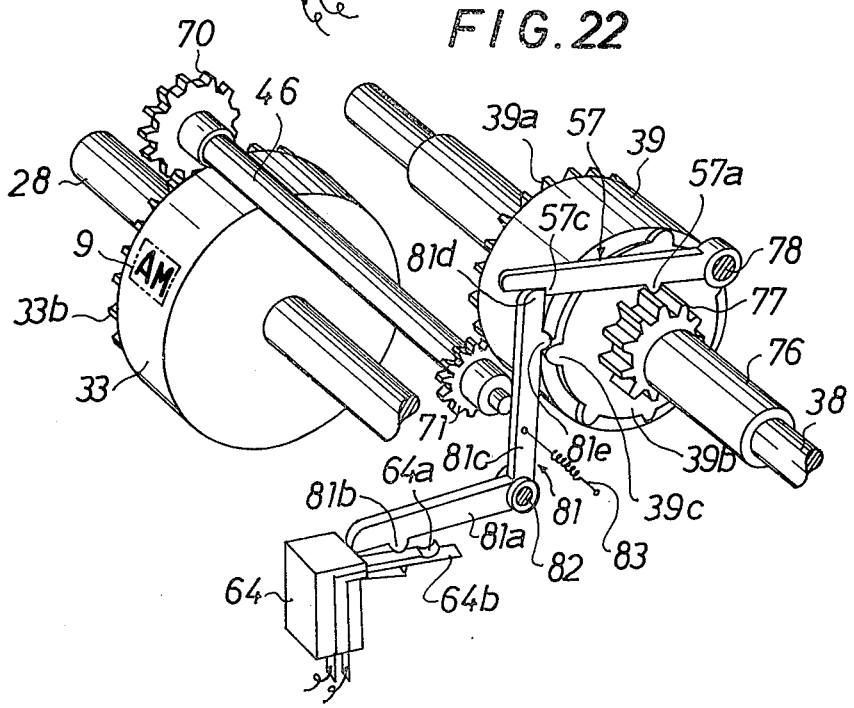
Figure 23:
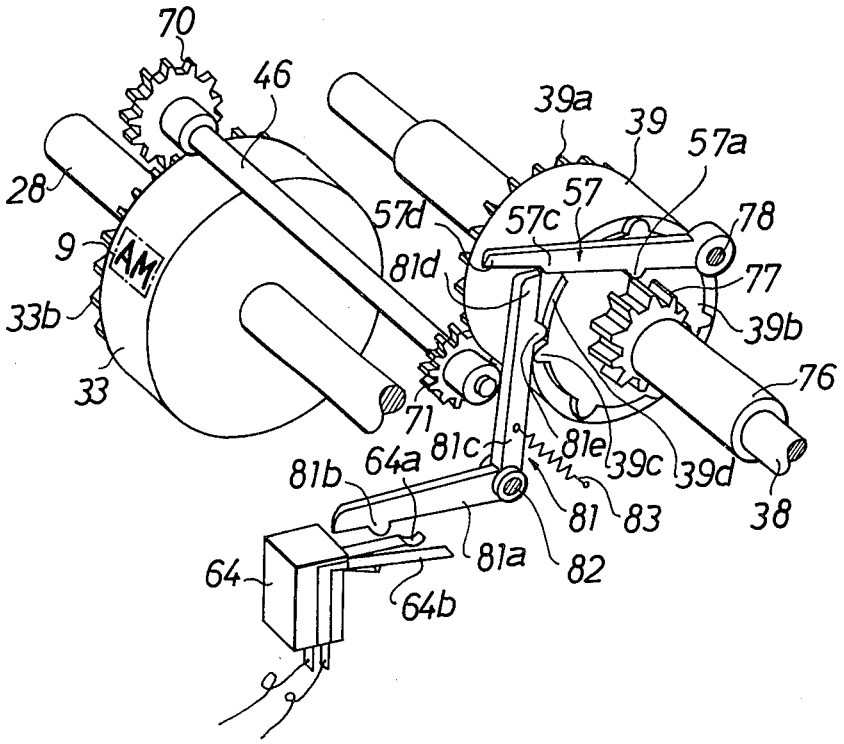

The start of a calendar operation beginning with 0 o'clock a.m. will be described below with reference to FIGS. 19 to 23. As mentioned previously, a rotation of the seconds display drum 29 in the clock causes a carry to be propagated through the carry pinion gears 60, 61 and 62 to the unit's minute, tens' minute and hour drums, respectively. During the time the combination of numerals presented within the display windows by the drums 30, 31 and 32 changes from 11 o'clock 59 minutes to 12 o'clock 00 minutes, a carry is propagated to the a.m.–p.m. display drum 33 to change a display thereof, and simultaneously the weekday feed relay gear 70 rotates by its meshing engagement with the weekday feed gear 33*b* located on the lateral side of the a.m.–p.m. display drum 33, whereby the rotation thereof is transmitted through the carry pinion shaft 46 of the calendar to rotate the weekday advance output gear 71, resulting in a rotation of the weekday gear 39*a* which meshes with the output gear 71 to cause a rotation of the weekday display drum 39 through 1/14 revolution to change the display of weekday presented within the weekday display window 10 (see FIG. 1). FIG. 19 illustrates an intermediate stage during the change from a.m. to p.m. A date operating cam 39*b* having seven projections 39*c* spaced apart at an equal spacing along the periphery thereof is integrally formed on the lateral side of the weekday display drum 39 which is loosely fitted on the hollow shaft 76 which is in turn loosely fitted on the main shaft 38 of the calendar. In this Figure, a fork-shaped switching lever 81 is pivotally mounted on a pivot 82 which is mounted on the side plate 26, and has a pair of arms 81*a* and 81*c*. Adjacent to its free end, the arm 81*a* which operates as a switching arm is provided with a switch operating tab 81*b*, which is adapted to abut against a movable contact 64*a* of a calendar operating switch 64. The free end of the other arm 81*c* is formed with a lock head 81*d*, and an operating projection 81*e* is formed on this arm intermediate its ends. A spring 83 urges the switching lever 81 so as to cause the operating projection 81*e* to bear against the recess 39*d* formed in the outer periphery of the date operating cam 39. Under this condition, the movable contact 64*a* of the calendar operating switch 64 is kept free from contact with its mating contact 64*b*, or the switch is off. When the weekday display drum 39 rotates and the projection 39*c* of the date operation cam 39*b* pushes up the operating projection 81*e* of the switching lever 81, the latter is rotated counter-clockwise, as viewed in this Figure, about the pivot 82, causing the switch operating tab 81*b* to force the movable contact 64*a* into engagement with its mating contact 64*b* to turn on the switch. The keep plate 57 is formed with a break projection 57*a* intermediate its ends, which projection 57*a* is adapted to engage, under the action of spring 80 (see FIG. 6), the valley between the teeth of a unit's day indexing gear 77 secured to the hollow shaft 76 so as to rotate in a similar manner as the unit's day display drum 41, the indexing gear 77 having 11 teeth. The free end of the keep lever 57 is notched to provide a step-like keep stop 57*c*, against which the lock head 81*d* can bear to prevent the break projection 57*a* from engagement with the valley in the unit's day indexing gear 77 when the operating projection 81*e* of the switching lever 81 bears against the recess 39*d* in the outer periphery of the date operating cam 39*b*. When the operating projection 81*e* of the switching lever 81 is pushed up by the projection 39*c* of the date operating cam 39*b*, the lock head 81*d* is disengaged from the position in which it locks the keep stop 57*c* and moves along the notched portions 57*d* thereof, whereby the keep lever 57 rotates counterclockwise, as viewed in this Figure, about its pivot 78 under the action of the spring, causing the break projection 57*a* to engage the valley between the teeth of the unit's day indexing gear 77. When the projection 39*c* has further moved past the position in which it pushes up the operating projection 81*e* and into a position in which the recess 39*d* in the date operating cam 39*b* is located opposite to the operating lever 81*e*, the lock head 81*d* cannot engage therewith because the switching lever 81 is locked in the notch 57*d* of the keep stop 57*c*. As a consequence, the movable contact 64*a* of the calendar operating switch 64 continues to be urged by the switch operating tab 81*b* into contact with the mating contact 64*b*, maintaining the on condition of the switch. When the drive motor 49 of the calendar rotates to commence the rotation of the unit's day display drum 41 to thereby cause a rotation of the hollow shaft 76 as well as the unit's day indexing gear 77, the ramp surface of the break contact 57*a* of the keep lever 57 which is maintained in engagement under the action of the spring is pushed up by the tooth of the gear 77, whereby the keep lever is rocked about its pivot 78 to raise the notch 57*d* in the keep stop 57*c*, thus unlocking the lock head 81*d*. Thereupon, the switching lever 81 rotates about the pivot 82 under the action of the spring 83 to bring the operating projection 81*e* into abutting engagement with the recess 39*d* in the date operating cam 39*b* and turning off the calendar operating switch 64. The engagement of the break projection 57*a* within the valley in the unit's day indexing gear 77 is prevented by the abutment of the keep stop 57*c* against the top of the lock head 81*e*. The termination of a change from a.m. to p.m. is shown in FIG. 20, where the display is completely changed to p.m. In this Figure, one of the seven projections 39*c* on the date operating cam 39*b* is at rest at a position immediately preceding its abutting engagement against the operating projection 81*e* of the switching lever 81, and the operating projection 81*e* bears against the recess 39*d* thereof, whereby the switch operating tab 81*d* is not urged against the movable contact 64*a* of the calendar operating switch 64, maintaining the switch in an off condition. As a result, the drive motor 49 of the calendar is not driven and the display of the date remains unchanged, and the keep stop 57*c* of the keep lever 57 is locked by abutment against the lock head 81*d* of the switching lever 81. Under this condition, when the clock changes from 11 o'clock 59 minutes p.m. to 12 o'clock 00 minutes a.m., the rotation of the a.m.–p.m. display drum 33 in the clock is transmitted through the weekday feed relay gear 70, the carry pinion shaft 46 and the weekday feed output gear 71 to the weekday display drum 39, which therefore commences to rotate, this causing a rotation of the projection 39*c* of the date operating cam 39*b*. The projection 39*c* continues its rotation while pushing up the operating projection 81*e* of the switching lever 81 and comes to a stop at a position in which it has completed the displacement of the operating projection 81*e* by the projection 39*c*. This represents a single operation of the weekday display drum 39 during an interval of the change from 11 o'clock 59 minutes p.m. to 12 o'clock 00 minutes a.m. The angle of rotation is 360°/14, and it accompanies a change of weekday. FIG. 21 shows an intermediate stage during the rotation of the date operating cam 39*b* through 360°/14 in which the projection 39*c* has pushed up the operating projection 81*e*. The switching lever 81 is consequently rotated about the pivot 82 to urge its switch operating tab 81*b* against the movable contact 64*a* of the calendar operating switch 64, which is therefore forced into contact with its mating contact 64*b* to turn on the switch. When the operating projection 81*e* is pushed up, the lock head 81*d* moves into the stepped notch 57*d* in the keep stop 57*c* of the keep lever 57, so that the latter rotates about its pivot 78 under the action of the spring 80 (see FIG. 6) to cause the break projection 57*a* to engage the valley between the teeth of the unit's day indexing gear 77. Also the movement of the keep lever 57 permits the lock head 81*d* to be locked in the notched step in the keep stop 57*c*. FIG. 22 illustrates the state when the date operating cam 39*b* has completed its movement through 360°/14. In this position, the projection 39*c* has moved to a position in which it does not push up the operating projection 81*e*, and while the switching lever 81 tends to move to a position under the action of the spring in which the operating projection 81*e* bears against the recess 39*d*, such movement is prevented by the abutment of the lock head 81*d* against the keep stop 57*c*. Since the calendar operating switch 64 remains on, the drive motor 49 of the calendar rotates to rotate the unit's day display drum 41 and simultaneously the unit's day indexing gear 77 is rotated through the hollow shaft 76 to move up the break projection 57*a* which is then engaged, thus assuming the position shown in FIG. 23. The upward movement of the break projection 57*a* results in a rotation of the keep lever 57 about its pivot 78, accompanying an upward movement of the keep stop 57*c*, whereby the lock head 81*d* of the switching lever 81 is disengaged from the notched step 57*d* in the keep stop 57*c*. As a consequence, the switching lever 81 is rotated under the action of the spring about the pivot 82 to bring its operating projection 81*e* into abutting engagement against the recess 39*d* in the date operating cam 39*b* and turning off the calendar operating switch. When the unit's day indexing gear 77 has completed its rotation, the break projection 57*a* on the keep lever 57 tends to engage the space between the teeth of the unit's day indexing gear 77, but such engagement is prevented by the abutment of the keep stop 57*c* against the lock head 81*d*. When the time proceeds from 11 o'clock 59 minutes a.m. to 12 o'clock 00 minute p.m., the weekday display drum 39 rotates again through 360°/14 to cause a movement of the recess 39*d* while maintaining abutment with the operating projection 81*e*, but the projection 39*c* does not push up the operating projection 81*e*, so that the calendar operating switch 64 is not turned on. The same weekday remains to be displayed within the weekday display window 10 (see FIG. 1).

Figure 24:
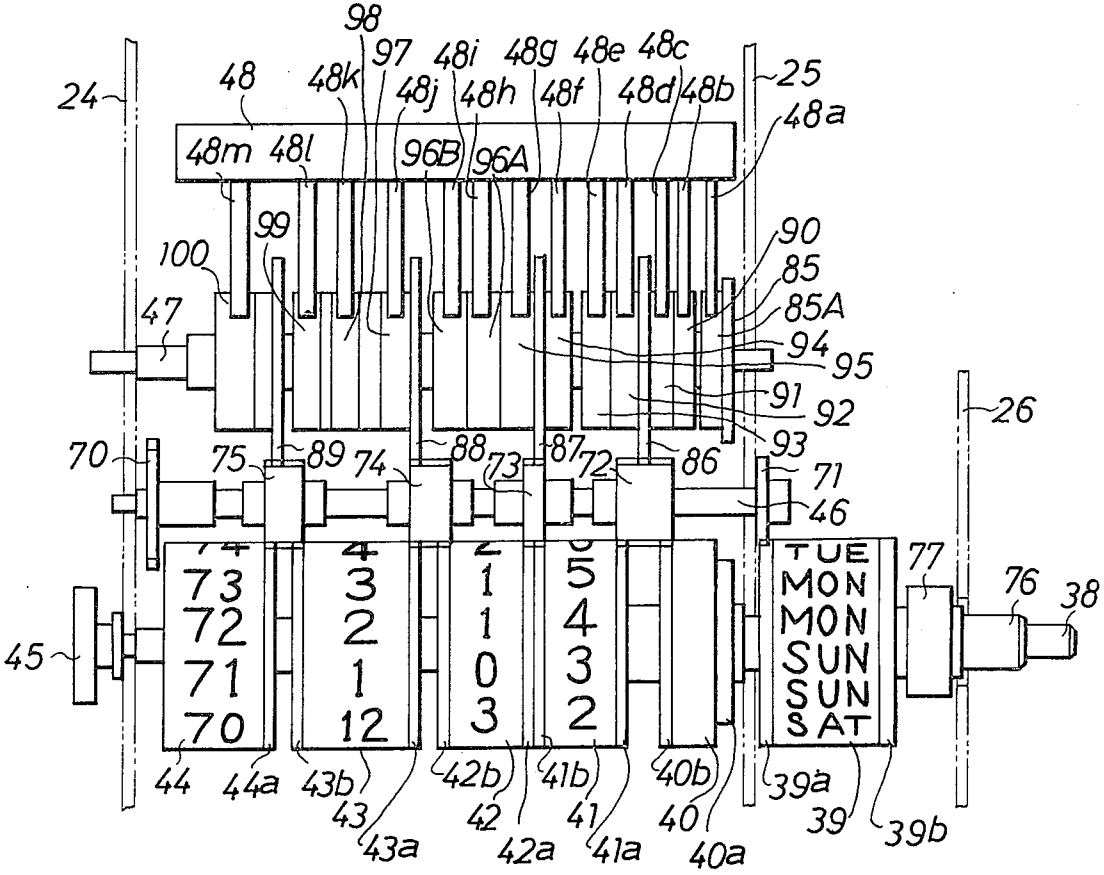
FIG. 24 is a view showing the calendar memory.

The operation of the calendar memory mechanism will be described with reference to FIGS. 24 and 25. A keep cam gear 85 loosely fitted on the memory cam shaft 47 is integrally formed with a keep cam 85A, and meshes with the relay gear 51 (see FIG. 2) to have the rotation of the drive motor 59 to be transmitted thereto through the relay gear 51, thus rotating at the same speed with (or at a proportional rate to that of) the date operating wheel 40. The keep cam gear 85 commences its rotation, upon energization of the drive motor 49, from a rest position in which the intermittent gear 40*b* having spaced apart teeth separated at an equal interval and rotating integrally with the date operating wheel 40 is about to mesh with the one day feed pinion gear 72, and functions so that the keep cam 85A maintains the switch on during the time while the intermittent gear 40*b* meshes with the one day feed pinion gear 72 to rotate the date operating wheel 40, one day feed pinion gear 72 and unit's day display drum 41 through angles corresponding to one day. At this end, the keep cam 85A is provided with convex areas 85A-*a* which are adapted to turn on the keep switch 48*a* of the memory switch mechanism 48, and also provided with recessed areas 85A-*b* which turn the switch 48*a* off. Before the drive motor 49 is energized, the keep cam 85A is located so that one of the recessed areas 85A-*b* is located opposite to the keep switch 48*a*, thus maintaining the keep switch 48*a* in an off condition. When the drive motor 49 starts to rotate the keep cam 85A to bring its convex area 85A-*a* into a position opposite to the keep switch 48*a* before the calendar operating switch 64 is turned off, the keep switch 48*a* is turned on. As the drive motor 49 further rotates to complete an intermittent feed corresponding to one day, the recessed area 85A-*b* of the keep cam 85A moves to a position opposite to the keep switch 48*a*, thereby turning it off. Each time the drive motor 49 is energized, the intermittent feed rotation by an amount corresponding to one day and the turning on and off of the keep switch 48*a* as a result of operation of the keep cam 85A are repeated. Thus, before the drive motor 49 is energized (that is, before 0 o'clock a.m.), one of the recessed areas 85A-*b* is opposite to the keep switch 48*a* to turn it off, and the toothed portion of the intermittent gear 40*b* associated with the date operating wheel 40 remains at rest at a position in which it does not mesh with the one day feed pinion gear 72. When the display in the clock changes from 11 o'clock 59 minutes p.m. to 12 o'clock 00 minutes a.m., the calendar operating switch 64 is turned on, starting the drive motor 49, the rotation of which is transmitted through the relay gear 51 to the date operating wheel 40 and the keep cam gear 85, whereby the keep cam 85A is rotated to bring one of its convex areas 85A-*a* opposite to the keep switch 48*a* to turn it on. As the rotation continues, the toothed portion of the intermittent gear 40*b* associated with the date operating wheel 40 meshes with the one day feed pinion gear 72 to impart an intermittent feed rotation through a definite angle to the gear 72, which therefore causes the one day feed gear 41*a* and the unit's day display drum 41 integral therewith to rotate through 360°/11. The rotation of the unit's day display drum 41 is transmitted through the hollow shaft 76 to rotate the unit's day indexing gear 77 through 360°/11, whereby the tooth on the unit's day indexing gear 77 pushes up the break projection 57*a*. In this manner, the lock head 81*d* of the switching lever 81 is unlocked to cause it to rotate, thus turning off the calendar operating switch 64. However, because the keep switch 48*a* remains on, the drive motor 49 of the calendar continues its rotation. The date operating wheel 40 also continues its rotation, and the toothed portion of the intermittent gear 40*b* associated with the operation wheel 40 is disengaged from its meshing with the one day feed pinion gear 72 and the hiatus thereof is located opposite to the pinion gear 72, whereby the date operating wheel 40 ceases to rotate. Subsequently one of the recessed areas 85A-*b* of the keep cam 85A moves opposite to the keep switch 48*a*, thereby turning it off and interrupting the drive motor 49.

The memory cam shaft 47 of the calendar also has a unit's day cam gear 86, a tens' day cam gear 87, a month cam gear 88 and a year cam gear 89 loosely fitted thereof, in addition to the keep cam gear 85. The unit's day cam gear 86 is provided with four cams integrally formed on its both lateral sides, and one of these cams constitutes a unit's day pass memory cam 90 which is located opposite to the unit's day pass memory switch 48*b*. Another cam constitutes a detection switch 91 for detecting the unit's day at the end of February of a common year and is located opposite to the detection switch 48*c* for detecting the unit's day at the end of February of a common year, and a third cam constitutes a detection switch 92 for detecting the unit's day at the end of February of a leap year and is located opposite to the detection switch 48*d* for detecting the unit's day at the end of February of a leap year. Fourth cam constitutes a detection switch 93 for detecting the end of a short month and is located opposite to the detection switch 48*e* for the end of a short month. The unit's day cam gear 86 has the same gear ratio as the one day feed gear 41*a* integrally provided on the lateral side of the unit's day display drum 41, and meshes with the one day feed pinion gear 72 so as to be imparted with a rotation through an angle which is equal to the intermittent rotation of the unit's day display drum 41. As the unit's day display drum 41 intermittently rotates through an angle of 360°/11 to present the unit's day displaying numerals in the sequence of 0, 1, 1 (hereinafter referred to as 1*b*), 2, 3, 4, 5, 6, 7, 8 and 9, the unit's day cam gear 86 and the four cams 90, 91, 92 and recessed areas located opposite to the corresponding switches 48*g*, 48*h* and 48*i* to turn them on.

The relationship between the numerals displaying the tens' day on the tens' day display drum 42 which can be viewed through the tens' day display window 12, the angular position of the cams 94, 95, 96A and 96B and the on and off condition of the switches 48*f*, 48*g*, 48*h* and 48*i* is indicated on the Table 2 below:

TABLE 2

| Numeral of tens' day digit | Tens' day cams | | | | Tens' day switches | | | |
|---|---|---|---|---|---|---|---|---|
| | 94 | 95 | 96A | 96B | 48f | 48g | 48h | 48i |
| 0 | R | R | R | R | OFF | OFF | OFF | OFF |
| 1 | R | R | R | R | OFF | OFF | OFF | OFF |
| 1B | C | R | R | R | ON | OFF | OFF | OFF |
| 2 | R | R | R | R | OFF | OFF | OFF | OFF |
| 2B | C | C | R | R | ON | ON | OFF | OFF |
| 3 | R | C | C | C | OFF | ON | ON | ON |

The month cam gear 88 is integrally formed with three cams on its lateral side. One of these cams constitutes a short month cam 97 which is located opposite to the short month detection switch 48*j* of the memory switch mechanism 48, and another cam constitutes a cam 98 for February of a common year which is located opposite to the detection switch 48*k* for February of a common year. A third cam constitutes a cam 99 for February of a leap year and is located opposite to the detection switch 48*l* for February of a leap year. The month cam gear 88 has the same gear ratio as the month feed gear 43*a* integrally provided on the lateral side of the month display drum 43, and meshes with the month feed gear 43*a* through a month feed pinion gear 74 for intermittent rotation through the same angle as the intermittent rotation of the month display drum 43. As the month display drum 43 intermittently rotate in increment of 30° to present the numerals displaying the month in the sequence of 1, 2, 3 . . . 12, the month cam gear 88 rotates in following relationship therewith to cause the three cams 97, 98 and 99 to present their convex and recessed areas formed on their periphery against the corresponding switches 48*j*, 48*k* and 48*l*, respectively, in a manner such that when a convex area on any of the three cams is located opposite to the corresponding switch, that switch is turned on, while the switch is turned off when a recessed area of the corresponding cam is located opposite thereto. Describing the switching on and off of the switches 48*j*, 48*k* and 48*l* in response to the three cams 97, 98 and 99, when the numeral 1 is presented within the month display window, the three cams 97, 98 and 99 have their recessed areas located opposite to the corresponding switches 48*j*, 48*k* and 48*l* to turn all of them off. When the numeral 2 is presented within the month display window 13, the three cams 97, 98 and 99 have their convex areas located opposite to the switches 48*j*, 48*k* and 48*l* to turn them on. When any one of the numerals 3, 5, 7, 8, 10 and 12 is presented within the month display window 13, the three cams 97, 98 and 99 have their recessed areas located opposite to the corresponding switches 48*j*, 48*k* and 48*l* to turn them all off. When either one of the numerals 4, 6, 9 and 11 is presented within the month display window 13, the short month cam 97 have its convex area 97*a* located opposite to the corresponding short month detection switch 48*j* to turn it on, while other cams 98 and 99 have their recessed areas located opposite to the corresponding switches 48*k* and 48*l* to turn them off.

The relationship between the numerals displaying the month on the month display drum 43 which can be viewed through the month display window 13, the angular position of the cams 97, 98 and 99 and the on and off condition of the switches 48*j*, 48*k* and 48*l* is indicated in the Table 3 below:

TABLE 3

| Numeral of month digit | Month cams | | | Month detection switches | | |
|---|---|---|---|---|---|---|
| | 97 | 98 | 99 | 48j | 48k | 48l |
| 1 | R | R | R | OFF | OFF | OFF |
| 2 | C | C | C | ON | ON | ON |
| 3 | R | R | R | OFF | OFF | OFF |
| 4 | C | R | R | ON | OFF | OFF |
| 5 | R | R | R | OFF | OFF | OFF |
| 6 | C | R | R | ON | OFF | OFF |
| 7 | R | R | R | OFF | OFF | OFF |
| 8 | R | R | R | OFF | OFF | OFF |
| 9 | C | R | R | ON | OFF | OFF |
| 10 | R | R | R | OFF | OFF | OFF |
| 11 | C | R | R | ON | OFF | OFF |
| 12 | R | R | R | OFF | OFF | OFF |

The year cam gear 89 is integrally provided with a year cam 100 on its lateral surface, which cam is located opposite to the leap year detection switch 48*m*. The year cam gear 89 has the same gear ratio as the year feed gear 44*a* which is integrally provided on the lateral surface of the year display drum 44, and meshes with the gear 44*a* through a year feed pinion gear 75 for an intermittent rotation through the same angle of rotation as the intermittent rotation of the year display drum 44. The cam 100 on the year cam gear 89 which rotates in the following relationship with the intermittent rotation of the month display drum 43 is provided with convex and recessed areas on its periphery to act on the corresponding switch 48*m*. The arrangement is such that when one of the convex areas 100*a* of the cam 100 is located opposite to the switch 48*m*, the latter is turned on, while when one of the recessed areas is located opposite to the switch, it is turned off. When a common year, for example, 1977, is indicated within the year display window 14, the year cam 100 has its convex area 100*a* located opposite to the leap year detection switch 48*m* to turn it on. When a leap year, for example, 1976, is indicated within the year display window 14, the cam 100 has its recessed area 100*b* located opposite to the switch 48*m* to turn it off. Thus, during three years which represent common years, the leap year detection switch 48*m* remain on, while it is changed into an off condition during a leap year.

In the above description dealing with the switching operation in response to the operation of the cams, it will be understood that the short month cam 97 may be arranged such that when the numeral 2 is presented within the month display window 13, the recessed area 97*b* of the short month cam 97 is located opposite to the short month detection switch 48*j* to turn it off. In the following description, this assumption is followed. While in the above described arrangement,, the unit's day cam gear 86, tens' day cam gear 87, month cam gear 88 and year cam gear 89 which are loosely fitted on the memory shaft 47 of the calendar have been described as meshing with the one day feed gear 41*a* associated with the unit's day display drum 41, the tens' day feed gear 42*a* associated with the tens' day display drum 42, the month feed gear 43*a* associated with the month display drum 43 and the year feed gear 44*a* associated with the year display drum 44, respectively, through the pinion gear 72, 73, 74 and 75, it is also possible to eliminate these pinion gears and to provide 93 rotates to turn the switches 48*b*, 48*c*, 48*d* and 48*e* mounted on the memory shaft 48 on and off, respectively. At this end, the four cams 90, 91, 92 and 93 are formed with necessary convex and recessed areas, and the arrangement is such that when a recessed area in any of these four cams 90, 91, 92 and 93 is located opposite to one of the switches 48*b*, 48*c*, 48*d* and 48*e*, the switch in question is turned off, while when a convex area is located opposite to a switch, that switch is turned on. Describing the switching operation afforded by the four cams 90, 91, 92 and 93 in more detail, when numeral 0 is presented within the unit's day display window 11, the unit's day pass memory cam 90 has its recessed area 90*b* located opposite to the unit's day pass memory switch 48*b* to turn it off; the detection switch 91 has its convex area 91*a* located opposite to the detection switch 48*c* to turn it on; the detection cam 92 has its convex area 92*a* located opposite to the detection switch 48*d* to turn it on; and the detection cam 93 has its recessed area 93*b* located opposite to the detection switch 48*e* to turn it off. When numeral 1 is presented within the unit's day display window 11, the cam 90 has its recessed area 90*b* located opposite to the switch 48*b* to turn it off; the cam 91 has its convex area 91*a* located opposite to the switch 48*c* to turn it on; the cam 92 also has its convex area 92*a* located opposite to the switch 48*d* to turn it on; and the detection cam 93 has its convex area 93*a* located opposite to the detection switch 48*e* to turn it on. When 1*b* on the unit's day digit is presented within the unit's day display window 11, the cam 90 has its convex area 90*a* located opposite to the switch 48*b* to turn it on; and other cams 90, 91, 92 and 93 have their recessed area located opposite to the corresponding switches 48*c*, 48*d* and 48*e* to turn off all of these switches. When either one of the numerals from 2 to 8 is presented within the unit's day display window 11, the four cams 90, 91, 92 and 93 have their recessed area located opposite to the corresponding switch 48*b*, 48*c*, 48*d* and 48*e* maintaining these switches in an off condition. However, when the numeral 9 is presented within the unit's day display window 11, the cam 91 has its convex area 91*a* located opposite to the switch 48*c* to turn it on, while the remaining cams 90, 92 and 93 have their recessed area located opposite to the switches 48*b*, 48*d* and 48*e* to turn these switches off.

The relationship between the numeral displaying the unit's day on the unit's day display drum 41 which can be viewed through the unit's day display window 11, the angular position of the cams 90, 91, 92 and 93, and the condition of the switches 48*b*, 48*c*, 48*d* and 48*e* is shown in the Table 1 below:

TABLE 1

| Numeral of unit's day digit | Unit's day cams | | | | Unit's day switches | | | |
|---|---|---|---|---|---|---|---|---|
| | 90 | 91 | 92 | 93 | 48b | 48c | 48d | 48e |
| 0 | R | C | C | R | OFF | ON | ON | OFF |
| 1 | R | C | C | C | OFF | ON | ON | ON |
| 1b | C | R | R | R | ON | OFF | OFF | OFF |
| 2 | R | R | R | R | OFF | OFF | OFF | OFF |
| 3 | R | R | R | R | OFF | OFF | OFF | OFF |
| 4 | R | R | R | R | OFF | OFF | OFF | OFF |
| 5 | R | R | R | R | OFF | OFF | OFF | OFF |
| 6 | R | R | R | R | OFF | OFF | OFF | OFF |
| 7 | R | R | R | R | OFF | OFF | OFF | OFF |
| 8 | R | R | R | R | OFF | OFF | OFF | OFF |
| 9 | R | C | R | R | OFF | ON | OFF | OFF |

Note: R represents a recessed area and C a convex area.

The tens' day cam gear 87 is integrally formed with three cams on its both lateral sides. One of these cams constitutes a tens' day pass memory cam 94 and is located opposite to the tens' day pass memory switch 48*f* of the memory switch mechanism 48, and another cam constitutes a cam 95 for the tens' day of the end of February of a common year and is located opposite to the detection switch 48*g* for detecting the tens' day of the end of February of a common year. The remaining cam is divided into two parts crosswise, onehalf of which constitutes a cam 96A for the tens' day of the end of February of a leap year and is located opposite to the detection switch 48*h* for detecting the tens' day of the end of February of a leap year, while the remaining one-half constitutes a cam 96B for the tens' day of the end of a short month and is located opposite to the detection switch 48*i* for detecting the tens' day of the end of a short month. The tens' day cam gear 87 has the same gear ratio as the tenth day carry or tens' feed gear 42*a* integrally provided on the lateral side of the tens' day display drum 42, and meshes with the ten day carry pinion gear 73 so as to be rotated through the same angle as the intermittent rotation of the tens' day display drum 42. As the tens' day display drum 42 intermittently rotates in increment of 30° to present the numerals displaying the tens' day in the sequence of 0, 1, 1 (hereinafter referred to as 1B), 2, 2 (hereinafter referred to as 2B), 3, 0, 1, 1B, 2, 2B and 3, the tens' day cam gear 87 rotates in following relationship therewith to present the convex and recessed areas provided on the periphery of the four cams 94, 95, 96A and 96B against the switches 48*f*, 48*g*, 48*h* and 48*i*, respectively, in a manner such that when a convex area on any of the four cams 94, 95, 96A and 96B is located opposite to one of the switches 48*f*, 48*g*, 48*h* and 48*i*, the corresponding switch is turned on, while when a recessed area is located opposite to any such switch, that switch is turned off. Describing the relationship between the four cams and the switches more fully, when the numeral 0 is presented within the tens' day display window 12, the four cams 94, 95, 96A and 96B have their recessed areas located opposite to the corresponding switches 48*f*, 48*g*, 48*h* and 48*i* to turn all of them off. When the numeral 1 is presented within the tens' day display window 12, the four cams 94, 95, 96A and 96B have their recessed areas located opposite to the respective switches to maintain them in an off condition. When the numeral 1B on the tens' day digit is presented within the tens' day display window 12, the tens' day pass memory cam 94 has its convex area 94*a* located opposite to the tens' day pass memory switch 48*f* to turn it on, while other cams 95, 96A and 96B have their recessed areas located opposite to the other corresponding switches 48*g*, 48*h* and 48*i* to maintain them in an off condition. When the numeral 2 is presented within the tens' day display window 12, the four cams 94, 95, 96A and 96B have their recessed areas located opposite to the corresponding switches 48*f*, 48*g*, 48*h* and 48*i* to turn all of them off. When the numeral 2B is presented within the tens' day display window 12, the cams 94 and 95 have their convex area 94*a* and 95*a* located opposite to the corresponding switches 48*f* and 48*g* to turn them on, while other cams 96A and 96B have their recessed areas located opposite to the corresponding switches 48*h* and 48*i* to turn them off. When the numeral 3 is presented within the tens' day display window 12, the cam 94 has its recessed area 94*b* located opposite to the corresponding switch 48*f* to turn it off, while other cams 95, 96A and 96B have their a direct meshing engagement between these cam gears and the feed gears.

Figure 25:
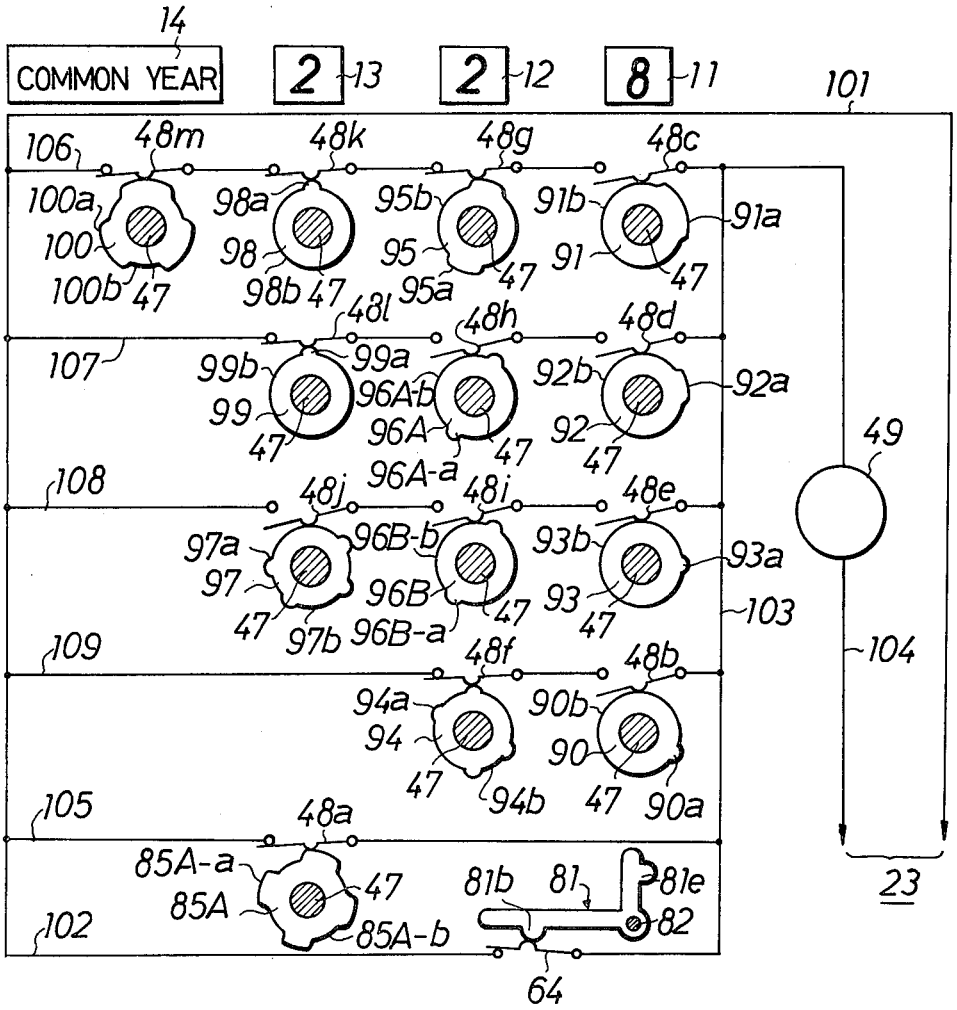
FIGS. 25 to 37 are circuit diagrams illustrating the manner of stepping of the calendar.
Figure 26:
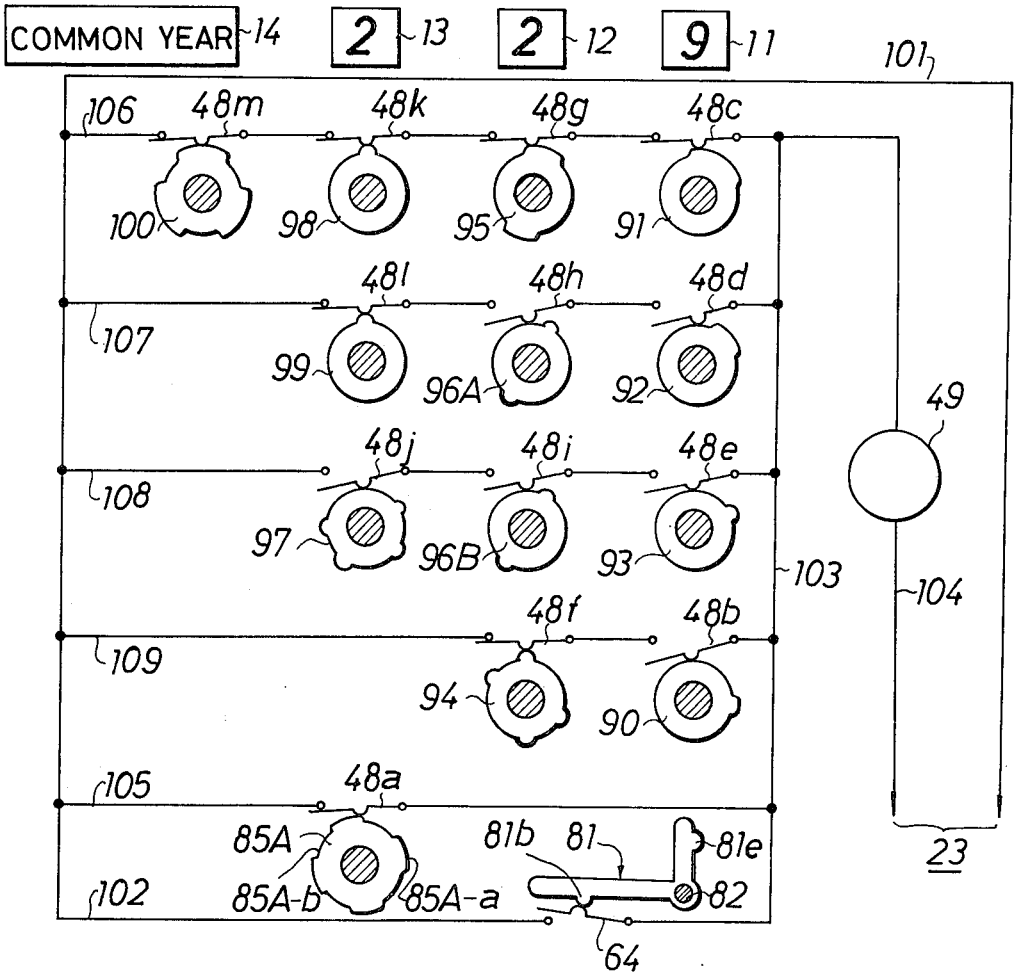
Figure 27:
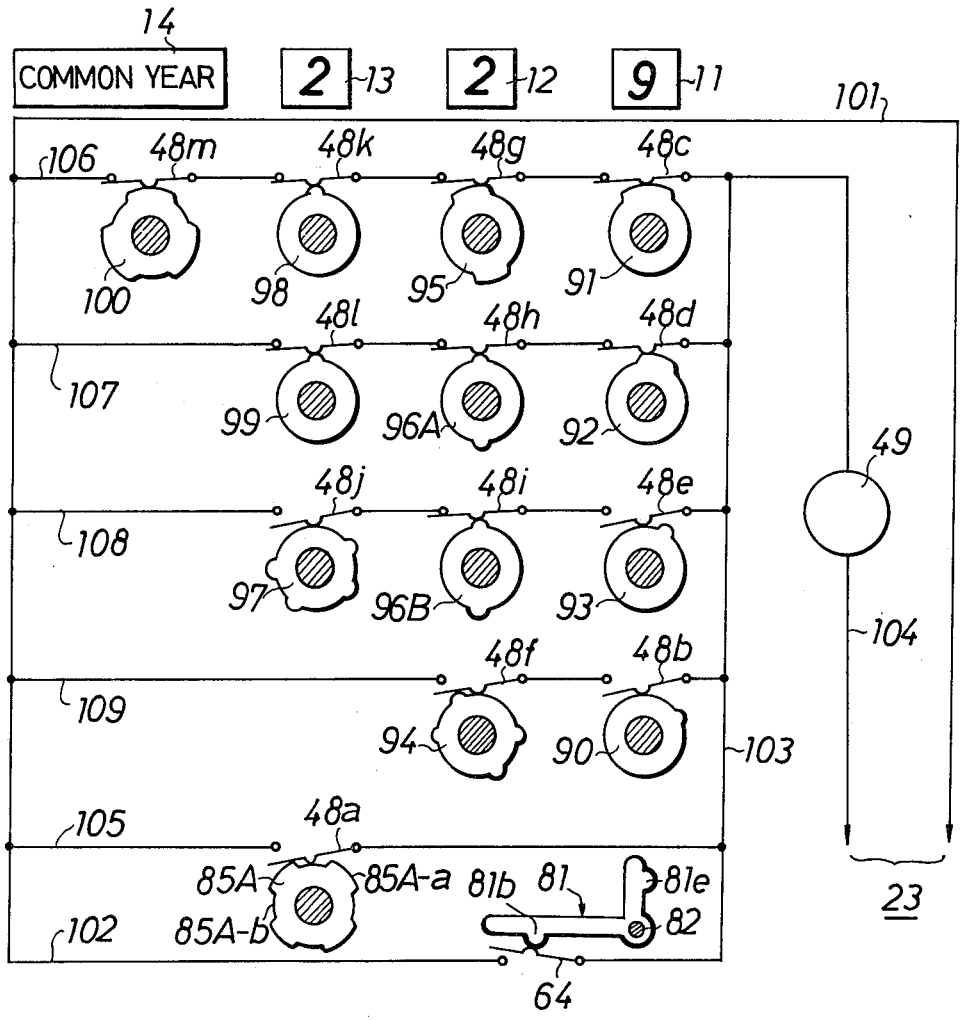
Figure 29:
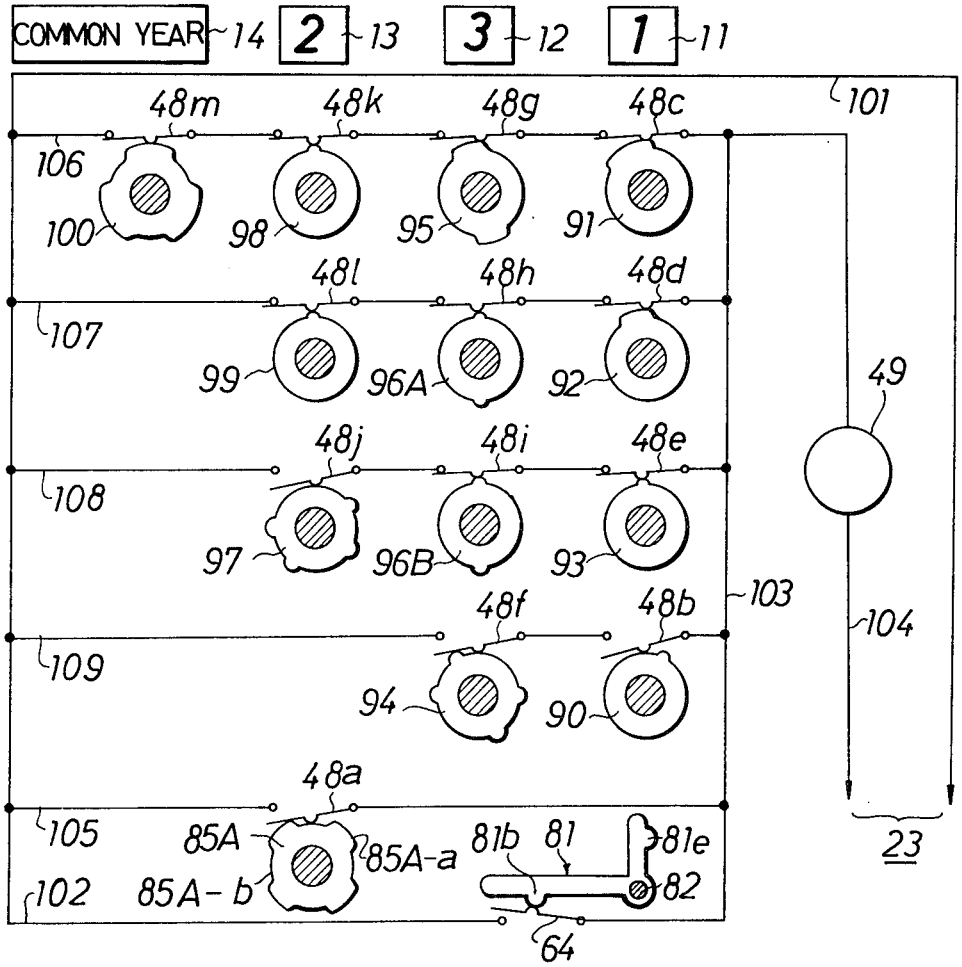
Figure 30:
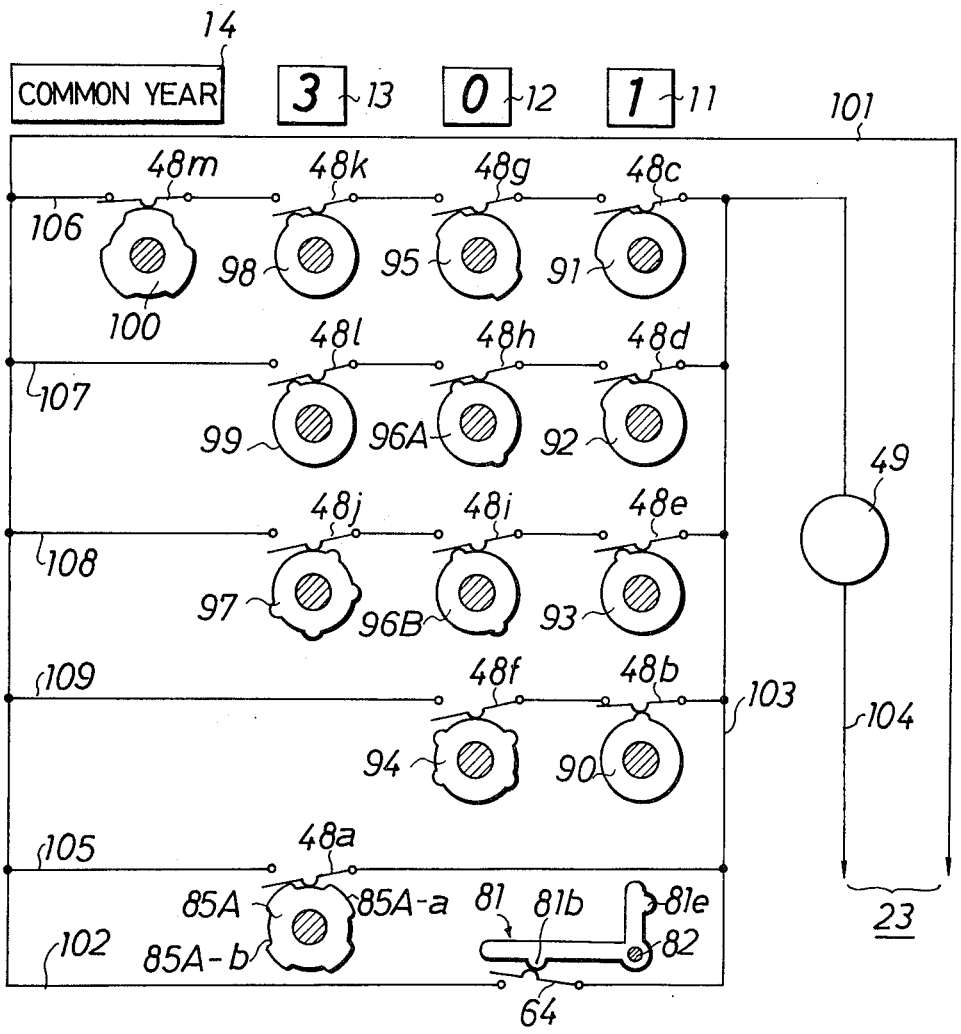

In FIG. 25, a common year, for example, 1978, is indicated within the year display window 14, the numeral 2 is indicated within the month display window 13, the numeral 2 is indicated within the tens' day display window 12, and the numeral 8 is indicated within the unit's day display window 11, thus indicating February 28th of a common year. In addition, the illustrated switching state represents 0 o'clock 00 minutes a.m. This condition has been reached through the operation of the date operating cam 39*b* which takes place to change the display from 11 o'clock 59 minutes p.m. to 12 o'clock 00 minutes a.m. Specifically, the switching lever 81 is rotated about the pivot 82 to cause its switch operating tab 81*b* to turn the calendar operating switch 64 on, whereby a lead wire 101 connecting with a branch operation wire 102 permits a current flow through the calendar operating switch 64 and a common return wire 103 to the drive motor 49 of the calendar, the current returning to the power source through a lead wire 104. As a result, the drive motor 49 starts to rotate, and its rotation is transmitted through the relay gear 51 meshing with the motor gear 49 to the date operating wheel 40 and the keep cam gear 85, whereby the keep cam 85A integral with the keep cam gear 85 rotates to present its convex area 85A-*a* against the keep switch 48*a* to turn it on, thereby enabling a keep wire 105 which branches from the lead wire 101 to conduct a current flow through the keep switch 48*a* and the common wire 103 to the drive motor 49 for continued rotation thereof. In addition to the operation wire 102 and the keep wire 105 connected with the lead wire 101 leading to the power source, there are four additional lines including a common year wire 106, a leap year wire 107, a short month wire 108 and a pass wire 109 branching from the lead wire 101. The common year wire 106 includes the leap year detection switch 48*m*, the detection switch 48*k* for February of a common year, the detection 48*g* for the tens' day at the end of February of a common year, and the detection switch 48*c* for the unit's day at the end of February of a common year, all of which are connected in series, and terminating in the common wire 103. These switches are disposed opposite to the cams 100, 98, 95 and 91. Specifically, the year cam 100 is located opposite to the leap year detection switch 48*m;* the cam 98 for February of a common year is located opposite to the detection switch 48*k;* the cam 95 for the tens' day at the end of February of a common year is located opposite to the detection switch 48*g;* and the cam 91 for the unit's day at the end of February of a common year is located opposite to the detection switch 48*c*. It will be understood that a current flow through the common year wire 106 and the common wire 103 to energize the drive motor 49 can occur only when all of the switches 48*m*, 48*k*, 48*g* and 48*c* are turned on, but is interrupted when any one of these switches is turned off. The leap year wire 107 includes the detection switch 48*l* for February of a leap year, the detection switch 48*h* for the tens' day at the end of February of a leap year, and the detection switch 48*d* for the unit's day at the end of February of a leap year, all of which are connected in series and terminate in the common wire 103. The cam 99 for February of a leap year is located opposite to the detection switch 48*l;* the cam 96A for the tens' day at the end of February of a leap year is located opposite to the detection switch 48*h;* and cam 92 for the unit's day at the end of February of a leap year is located opposite to the detection switch 48*d*. It will be understood that a current flow through the leap year wire 107 and the common wire 103 to energize the drive motor 49 can occur only when all of the switches 48*l*, 48*h* and 48*d* are turned on, but is interrupted when any one of these switches is turned off. The short month wire 108 includes a short month detection switch 48*j*, the detection switch 48*i* for the tens' day at the end of the short month, and the end of short month detection switch 48*e*, all of which are connected in series and terminate in the common wire 103. The short month cam 97 is located opposite to the short month detection switch 48*j;* the cam 96B for the tens' day at the end of the short month is located opposite to the detection switch 48*i;* and the end of the short month detection cam 93 is located opposite to the detection switch 48*e*. It will be understood that a current flow through the short month wire 108 and the common wire 103 to energize the motor 49 can occur only when all of these cams have their convex areas 97*a*, 96B-*a* and 93*a* located opposite to these switches 48*j*, 48*k* and 48*e* to turn them on, but is interrupted when any one of these switches is turned off. The pass wire 109 includes the tens' day pass memory switch 48*f* and the unit's day pass memory 48*b* connected in series, and terminates in the common wire 103. The tens' day pass memory cam 94 is located opposite to the tens' day pass memory switch 48*f*, and the unit's day pass memory cam 90 is located opposite to the unit's day pass memory switch 48*b*. Only when these cams have their convex areas 94*a* and 90*a* located opposite to the switches 48*f* and 48*b* to turn them on, a current flow can occur through the pass wire 109 and the common wire 103 to energize the drive motor 49 of the calendar, but no current can flow when either one of the switches 48*f* and 48*b* is turned off. By connecting the six branches including the common year wire 106, the leap year wire 107, the short month wire 108, the pass wire 109, the keep wire 105 and the operation wire 102 in parallel across the power source between the lead wire 101 and the common return wire 103, the drive motor 49 is energized for rotation whenever any one of six branches is completed. As shown in FIG. 25, the calendar operating switch 64 located in the operation wire 102 is turned on, whereby the drive motor 49 is energized to rotate the keep cam 85A, turning on the keep switch 48*a*. As a consequence, the branch including the keep wire 105 is completed to allow the drive motor 49 to continue its rotation, whereby the intermittent gear 40*b* associated with the date operating wheel 40 and the unit's day indexing gear 77 continue their rotation to result in an unlocking operation of the switching lever 81 by the tooth on the unit's day indexing gear 77, thereby turning off the calendar operating switch 64 and interrupting the current flow through the branch including the operation wire 102. However, since the branch including the keep wire 105 remains closed, the drive motor 49 of the calendar continues to rotate, so that the toothed portion of the intermittent gear 40*b* associated with the date oerating wheel 40 continues to rotate and meshes with the one day feed pinion gear 72 to impart rotation thereto to thereby cause the one day feed gear 41*a* meshing therewith and associated with the unit's day display drum 41 to rotate, causing the unit's day display drum 41 to rotate through 360°/11 before the one day feed pinion gear 72 is released from its meshing engagement. Subsequent to the termination of this rotation, the branch including the keep wire 105 remains closed, and the circuit assumes the condition illustrated in FIG. 26. FIG. 26 illustrates the condition prevailing immediately after the display has been changed to February 29th of a common year. At this time, all of the switches 48*m*, 48*k*, 48*j* and 48*c* in the branch including the common year wire 106 are turned on, and thus the both branches including the common year wire 106 and the keep wire 105 are completed to permit the drive motor 49 to continue its rotation. When the recessed area 85A-*b* of the keep cam 85A comes opposite to the keep switch 48*a*, the latter is turned off whereby the circuit assumes the condition illustrated in FIG. 27. FIG. 27 shows the termination of one day feed operation of the calendar subsequent to a change of the display into February 29th of a common year and from 11 o'clock 59 minutes p.m. to 0 o'clock 00 minute a.m. The branch including the leap year wire 107 is in an off condition as are the branches including the short month wire 108, the pass wire 109, the keep wire 105 and the operation wire 102. However, the switches 48*l*, 48*k*, 48*g* and 48*c* in the branch including the common year wire 106 all maintain their on condition, whereby the current flows fom the lead wire 101 to the drive motor 49 through the common year wire 106 and the common wire 103. The continued rotation of the motor 49 results in a rotation of the keep cam 85A, whereby the convex area 85A-*a* of the keep cam 85A renders the keep switch 48*a* on again. Simultaneously, the date operating wheel 40 continues its rotation, and the toothed portion of the intermittent gear 40*b* associated with this operating wheel 40 rotates to initiate its meshing engagement with the one day feed pinion gear 72 and impart rotation to the unit's day display drum 41 through the gear 72. The toothed portion 41*c* of the tens' feed, intermittent gear 41*b* associated with the unit's day display drum 41 initiates its meshing engagement with the ten day feed pinion gear 73 and causes a rotation of the tens' day feed gear 42*a* associated with the tens' day display drum 42 and meshing with the pinion gear 73, whereby both the tens' day and unit's day display drums 42 and 41 commence rotation simultaneously. When the toothed portion of the intermittent gear 40*b* associated with the date operating wheel 40 is released from its meshing engagement with the one day feed pinion gear 72, and thus ceases to impart rotation thereto (or upon completion of the one day feed operation), the toothed portion 41*c* of the tens' feed, intermittent gear 41*b* associated with the unit's day display drum 41 is also released from its meshing engagement with the ten day feed pinion gear 73, whereby the tens' day display drum 42 comes to a stop subsequent to the termination of an intermittent rotation through 30° and the unit's day display drum 41 comes to a stop subsequent to the termination of an intermittent rotation through 360°/11. The net effect of this is that the numeral representing a common year within the year display window 14 and the numeral 2 representing February within the month display window 13 remain unchanged, while the numeral displaying the tens' day within the tens' day display window 12 changes from 2 to 3 and the numeral representing the unit's day also changes from 9 to 0, thus the display windows 14, 13, 12 and 11 representing February 30th of a common year. The drive motor 49 of the calendar continues its rotation to perform all of the operation which end with the turning off of the keep switch 48*a* by having the recessed area 85A-*b* of the keep cam 85A located opposite thereto, thus assuming the condition illustrated in FIG. 28. Under the condition in which February 30th of a common year is displayed, the short month detection switch 48*j* and the end of short month detection switch 48*e* in the branch including the short month wire 108 are both turned off, and therefore cannot conduct current. Also the branches including the pass wire 109, keep wire 105 and operation wire 102 include switches therein which are turned off, and therefore cannot conduct current. However, the group of switches 48*m*, 48*k*, 48*g* and 48*c* in the branch including the common year wire 106 are maintained all on, as are the switches 48*l*, 48*h* and 48*d* in the branch including the leap year wire 107. As a consequence, the drive motor 49 of the calendar further continues its rotation, whereby the convex area 85A-*a* of the keep cam 85A rotates to turn on the keep switch 48*a* on again. Simultaneously, the toothed portion of the intermittent gear 40*b* associated with the date operating wheel 40 also rotates to perform one day feed operation, whereby the unit's day is advanced by one step or by one day, thus changing the numeral indicated within the unit's day display window 11 from 0 to 1. Thus, the numerals presented within the display windows 14, 13, 12 and 11 represent February 31st of a common year. The drive motor 49 of the calendar continues further rotation of perform all of the operations until the keep switch 48*a* is turned off as a result of the recessed area 85A-*b* of the keep cam 85A being located opposite thereto, thus assuming the condition shown in FIG. 29. Under the condition shown in FIG. 29 in which February 31st of a common year is displayed, the branches including the short month wire 108, the pass wire 109, the keep wire 105 and the operation wire 102 are turned off and cannot conduct current. However, the switches 48*m*, 48*k*, 48*g* and 48*c* in the branch including the common branch wire 106 are maintained all on as are the switches 48*l*, 48*h* and 48*d* in the branch including the leap year wire 107. As a consequence, the drive motor 49 further continues its rotation, whereby the keep cam 85A rotates to locate its convex area 85A-*a* opposite to the keep switch 48*a* to turn it on again. Also the toothed portion of the intermittent gear 40*b* associated with the date operating wheel 40 rotates to commence its meshing engagement with the one day feed pinion gear 72, whereby the unit's day display drum 41 commences its rotation by its meshing engagement with the year 72. This results in a rotation of the tens' feed, intermittent gear 41*b* associated with the unit's day display drum 41 to cause its toothed portion 41*d* to mesh with the ten day feed pinion gear 73, imparting rotation to the tens' feed gear 42*a* associated with the tens' day display drum 42 through the pinion gear 73 with which it meshes. Thus, the tens' day display drum 42 also commences its rotation, which results in the meshing engagement of the toothed portion 42*c* of the month feed, intermittent gear 42*b* associated with the display drum 42, with the month feed pinion gear 74, thus imparting rotation to the month feed gear 73*a* associated with the month display drum 43 through its meshing pinion gear 74. As a result, all of the month display drum 43, ten's day display drum 42 and unit's day display drum 41 commence rotation simultaneously, changing a display of both month and days. When the toothed portion of the intermittent gear 40*b* associated with the date operating wheel 40 is released from its meshing engagement with the one day feed pinion gear 74 and ceases to impart rotation thereto, the toothed portion 41*d* of the tens' feed, intermittent gear 41*b* associated with the unit's day display drum 41 is also released from its meshing engagement with the ten day feed pinion gear 73 and ceases to impart rotation thereto. Also the toothed portion 42*c* of the month feed, intermittent gear 42*b* associated with the tens' day display drum 42 is released from its meshing engagement with the month feed pinion gear 74 and ceases to impart rotation thereto. Consequently, during the interval from the commencement to the release of the meshing engagement between the toothed portions of the respective intermittent gears 40*b*, 41*b* and 42*b* and the pinion gears 72, 73 and 74, the month display drum 43 is rotated through 30°, the tens' day display drum 42 is also rotated through 30° and the unit's day display drum 41 is rotated through 360°/11 before each of them comes to a stop. In this manner, the numerals in the respective display drums 43, 42 and 41 are changed, while the numeral presented within the year display window 14 remains unchanged. Specifically, the numeral presented within the month display window 13 changes from 2 to 3; the numeral presented within the tens' day display window 12 changes from 3 to 0; and the numeral presented within the unit's day display window 11 changes from 1*a* to 1*b*. In other words, the numerals presented within the display windows 14, 13, 12 and 11 represent March 01 day (or 1st day where 0 is not displayed) of a common year. The drive motor 49 of the calendar further continues its rotation until the condition shown in FIG. 30 is reached where the keep switch 48*a* is turned off by one of the recessed areas 85A-*b* of the keep cam 85A. Under the condition shown in FIG. 30 in which March 01 day of a common year is displayed, all of the branches each including the common year wire 106, the leap year wire 107, the short month wire 108, the pass wire 109, the keep wire 105 and the operation wire 102 include the switches which are turned off, and therefore cannot conduct current, whereby the rotation of the drive motor 49 is interrupted.

Figure 28:
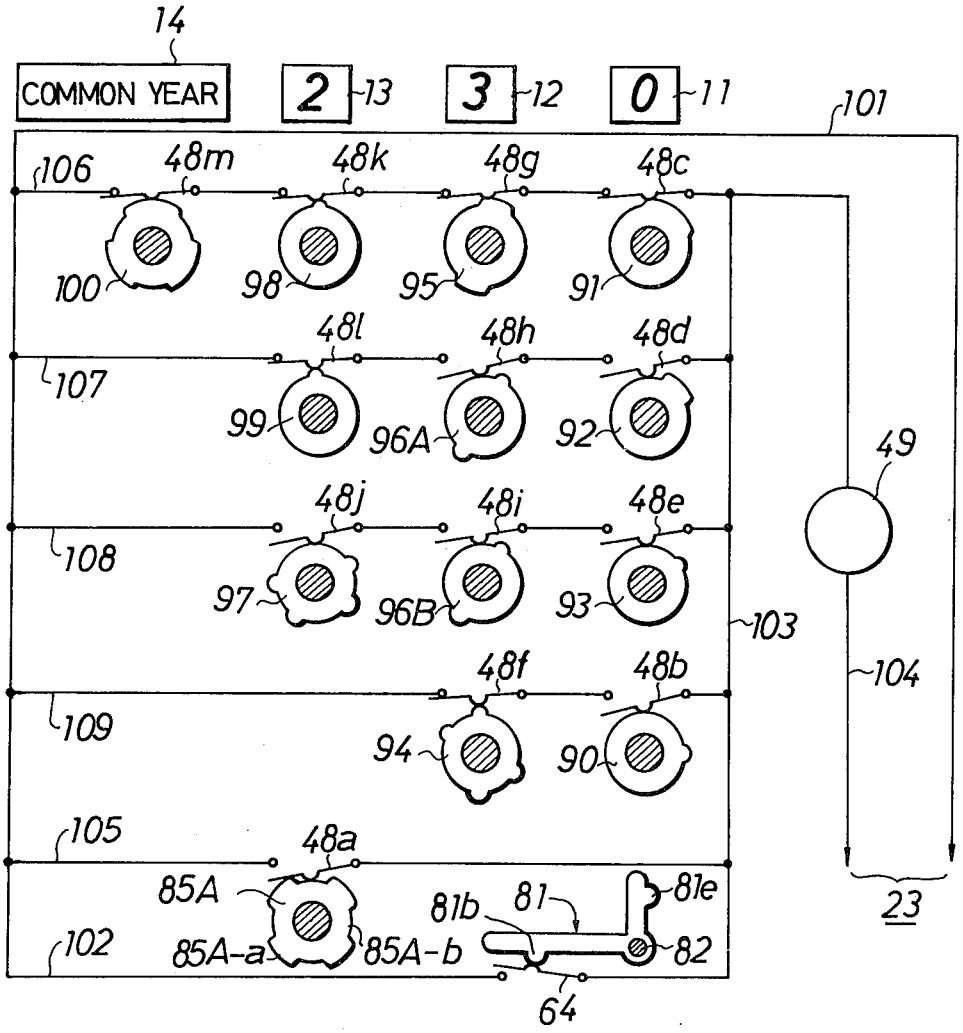

To summarize, under the condition shown in FIG. 25 which displays February 28th day of a common year, the clock operates on the memory mechanism of the calendar durting the interval in which the time changes from 11 o'clock 59 minutes p.m. to 0 o'clock 00 minute a.m. (or 12 o'clock 00 minute a.m.), causing the branch including the operation wire 102 to be closed to initiate the rotation of the drive motor 49. Initially, the branch including the keep wire 105 is completed to enable the drive motor 49 to continue its rotation, and during the time the path to energize the motor 49 is maintained by this branch, the branch including the operation wire 102 is interrupted to permit an operation in which the unit's day is changed as indicated by the condition in FIG. 26, whereupon the branch including the common year wire 106 is completed changing the display to February 29th of a common year. Further rotation of the drive motor 49 causes the branch including the keep wire 105 to be interrupted, but the energization of drive motor 49 is continued by the completed path through the branch including the common year wire 106 as shown in FIG. 27. When a change of the unit's day is performed for the second time, a carry operation takes place simultaneously to change the tens' day, whereby February 30th of a common year is displayed as indicated in FIG. 28. It will be noted that the branch including the common year wire 106 is still maintained in an on condition and that the branch including the leap wire 107 is also closed, so that the drive motor 49 continues its rotation to permit a change of the unit's day for the third time as shown in FIG. 29, thus displaying February 31st of a common year. The branches each including the common year wire 106 and the leap year wire 107 remains closed, thereby allowing the drive motor 49 to continue its rotation to permit another change of the unit's day. Thereupon, carry operations take place for the month and days, changing the month, tens' day and unit's day simultaneously to March 01st day of a common year as shown in FIG. 30. At this time, all of the branches including the wires 106, 107, 108, 109, 105 and 102 are interrupted, whereby the drive motor 49 of the calendar is de-energized. In this manner, a change of a display in the calendar which takes place at 11 o'clock 59 minutes p.m. on February 28th day of a common year is automatically accomplished, passing through February 29th, February 30th and February 31st and providing a display of March 01st day.

Figure 31:
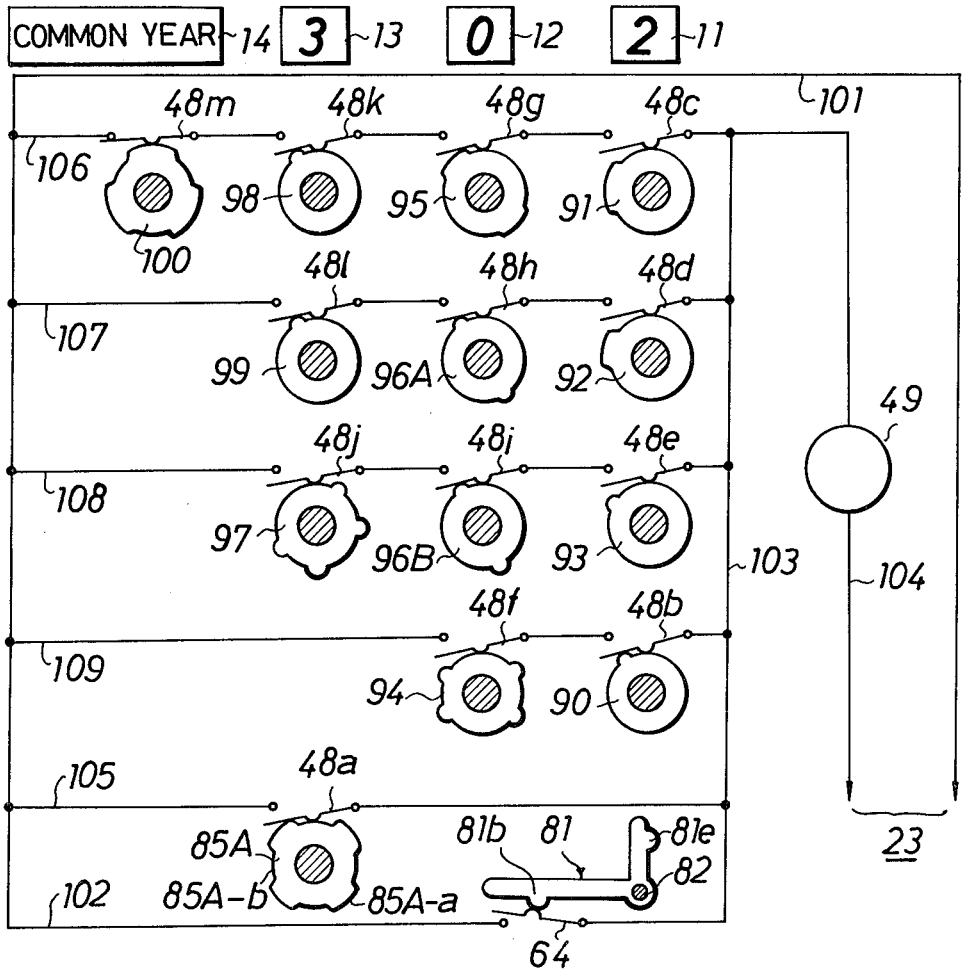

During an interval from 11 o'clock 59 minutes p.m. of March 01st day to 0 o'clock 00 minute a.m. (or 12 o'clock 00 minute a.m.), the clock operates on the calendar to complete the branch including the operation wire 102, whereby the drive motor 49 rotates to perform a normal one day feed operation, providing a display of March 02nd day of a common year within the display windows 14, 13, 12 and 11 as shown in FIG. 31. At this time, all of the branches each including the wires 106, 107, 108, 109, 105 and 102 are interrupted, so that the drive motor 49 is de-energized, thus limiting the feed operation to the normal one day feed operation from 11 o'clock 59 minutes p.m. of March 01st day to March 02nd day.

Figure 32:
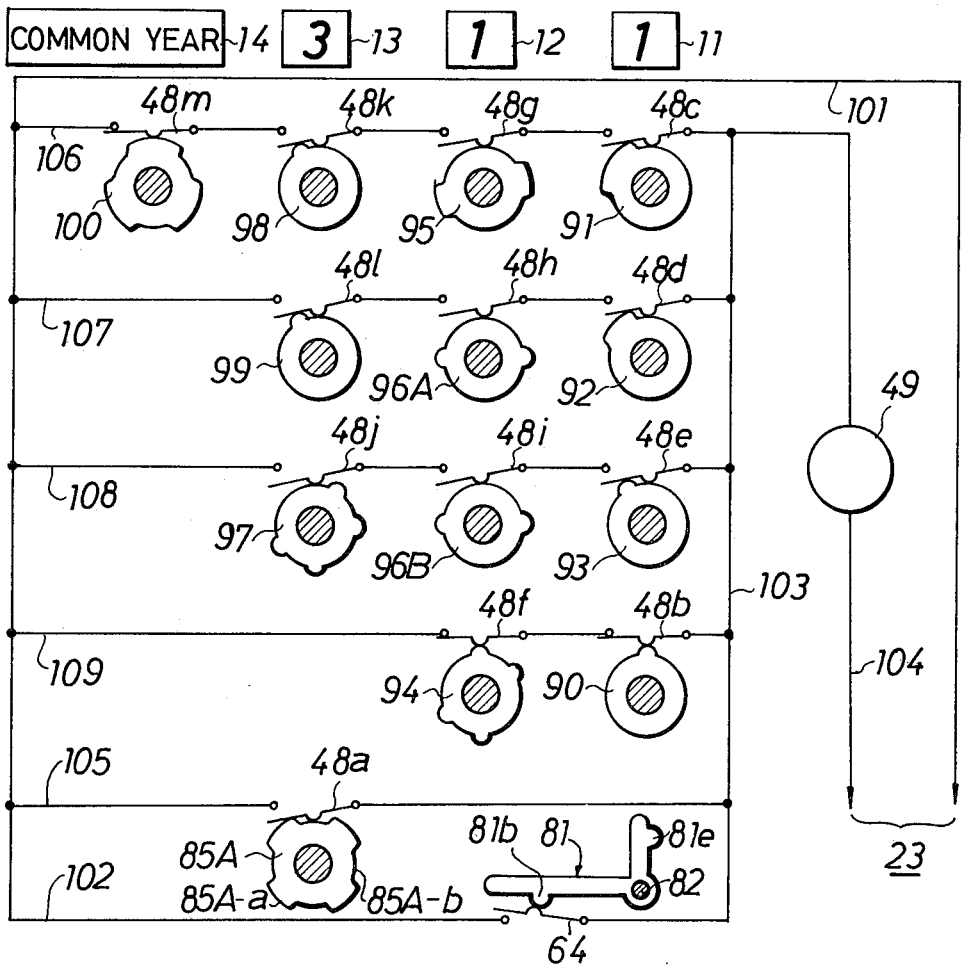
Figure 33:
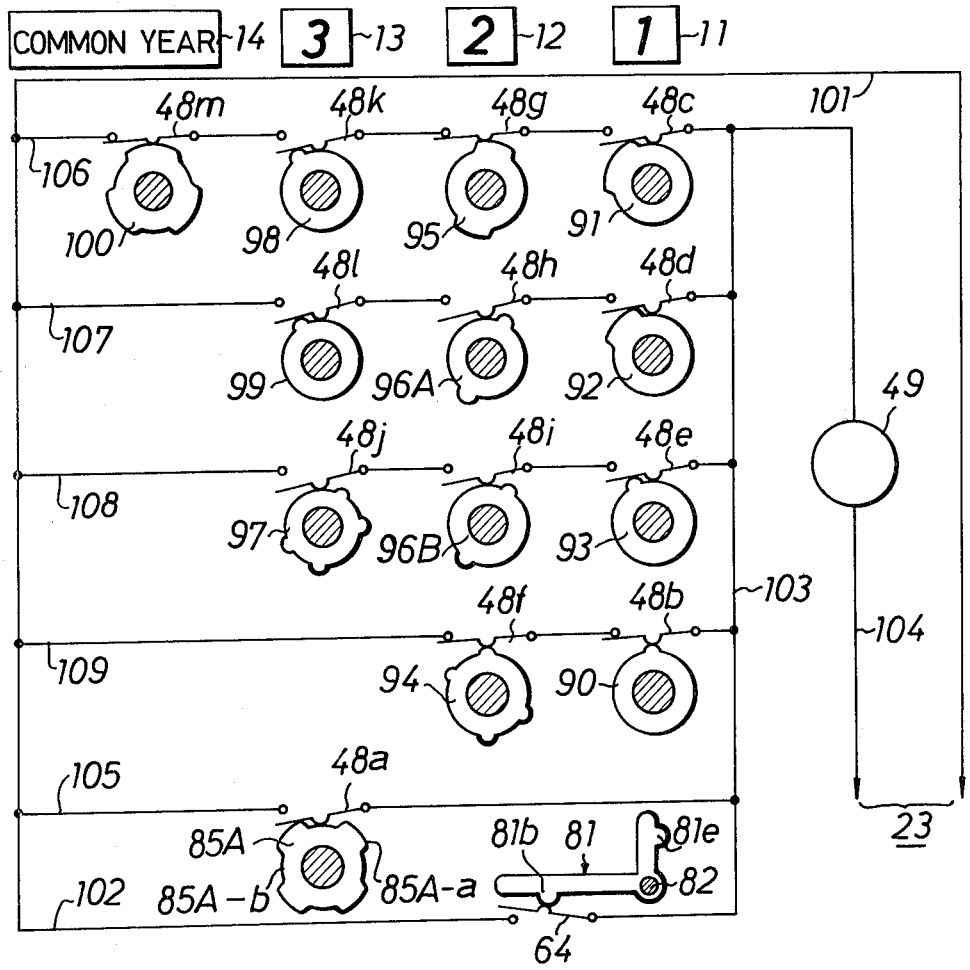

From 01st day to 10th day of every month, all of the branches each including the common year wire 106, leap year wire 107, the short month wire 108 and the pass wire 109 are interrupted, so that a normal one day feed operation takes place every time a change to 0 o'clock 00 minute a.m. occurs. When a change occurs from 11 o'clock 59 minutes of 09th day, the toothed portion 41*c* of the tens' feed, intermittent gear 41*b* associated with the unit's day display drum 41 meshes with the ten day feed pinion gear 73, which initiate the carry operation, so that both the unit's day and the tens' day display drums 41 and 42 rotate together to display 10th day. Subsequently, a normal one day feed operation takes place from 11 o'clock 59 minutes p.m. of 10th day to 11th day (a combination of 1A and 1*a*). When a normal one day feed operation takes place from 11 o'clock 59 minutes of 11th day of each month, the toothed portion 41*d* of the tens' feed, intermittent gear 41*b* associated with the unit's day display drum 41 meshes with the ten day feed pinion gear 73 for the purpose of performing the carry operation, whereby both the unit's day display drum 41 and the tens' day display drum 42 rotate together to propagate the carry, displaying the numeral 1 (1B) within the tens' day display window 12 and the numeral 1 (1*b*) within the unit's day display window 11 or displaying 11th day, as shown in FIG. 32. At this time, the branch including the pass wire 109 is completed to permit the drive motor 49 to continue its rotation, thus enabling a pass operation whereby one day is advanced to change the display to 12th day. Thus, the initially appearing 11th day (a combination of 1A and 1*a*) is displayed, but the following overlapped 11th day (a combination of 1B and 1*b*)

is passed to provide a display of 12th day. From 12th to 20th day of each month, the branches each including the common year wire 106, the leap year wire 107, the short month wire 108 and the pass wire 109 are interrupted, so that a normal one day feed operation takes place to 0 o'clock 00 minute a.m. of each day. When changing from 11 o'clock 59 minutes p.m. of 19th day, the toothed portion 41*c* of the tens' feed, intermittent gear 41*d* associated with the unit's day display drum 41 meshes with the ten day feed pinion gear 73 for performing the carry operation, whereby both the unit's day display drum 41 and the tens' day display drum 42 rotate together to display 20th day. When changing from 11 o'clock 59 minutes p.m. of 29th day, a normal one day feed operation takes place to display 21st day (a combination of 2A and 1*a*). When a normal one day feed operation takes place from 11 o'clock 59 minutes p.m. of 21st day of each month, the toothed portion 41*d* of the tens' feed, intermittent gear 41*b* associated with the unit's day display drum 41 meshes with the ten day feed pinion gear 73 for performing the carry operation, whereby both the unit's day display drum 41 and the tens' day display drum 42 rotate together to display 21st day (a combination of 2B and 1*b*) again within the tens' day display window 12 and the unit's day display window 11, as shown in FIG. 33. At this time, the branch including the pass wire 109 is completed to permit the drive motor 49 to continue its rotation, thereby enabling a pass operation to advance one more day to change the display to 22nd day. Thus, the initially appearing 21st day (a combination of 2A and 1*a*) is displayed, but the following overlapped 21st day (a combination of 2B and 1*b*) is passed to provide a display of 22nd day.

Figure 34:
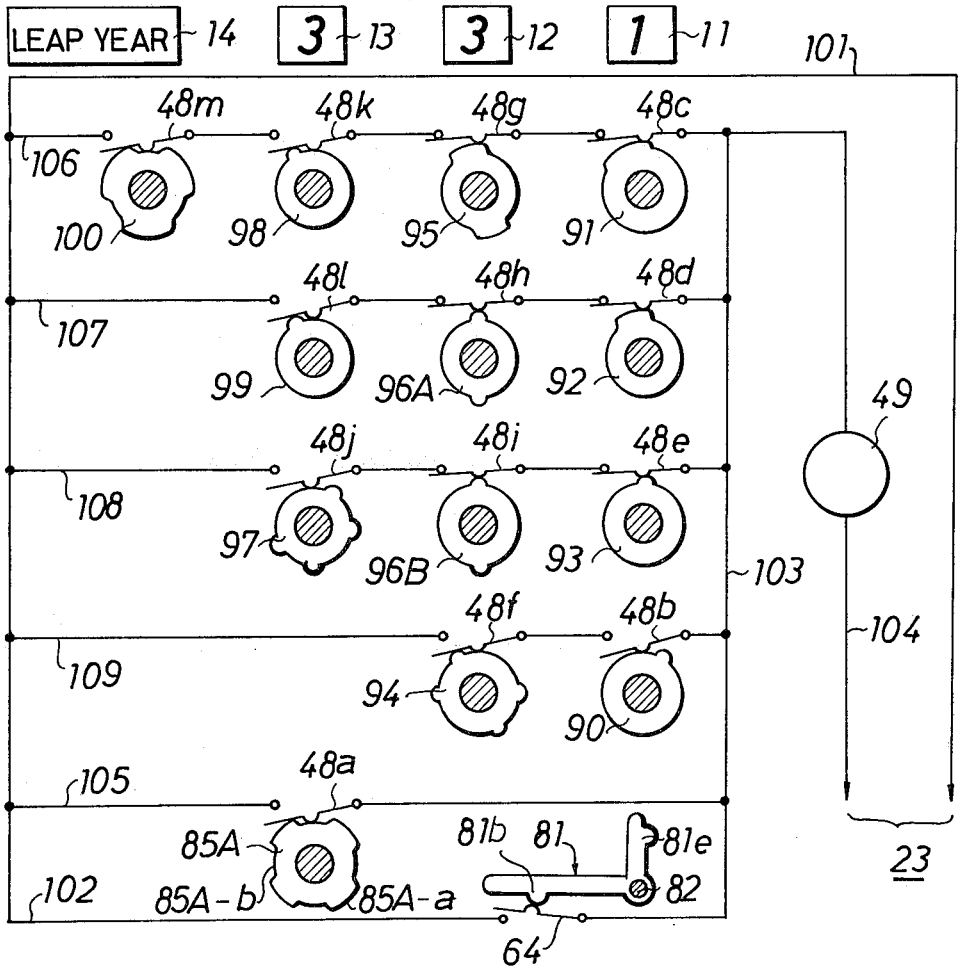
Figure 35:
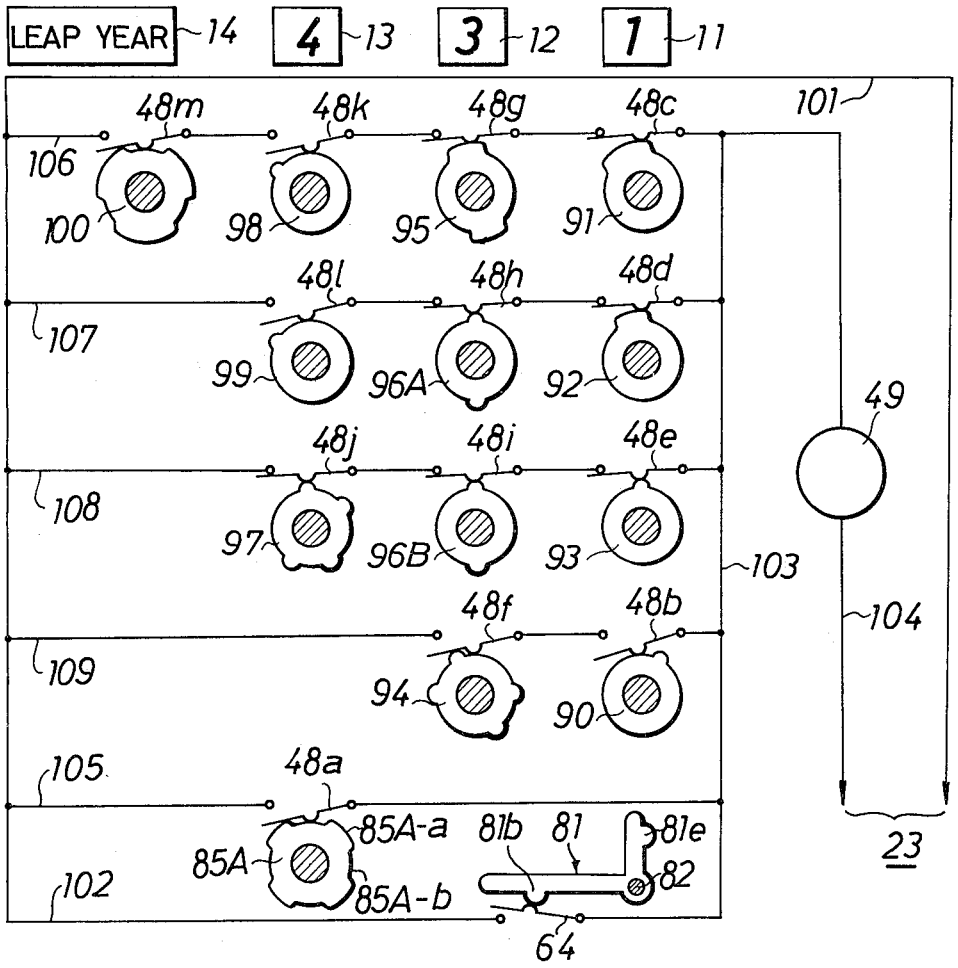
Figure 36:
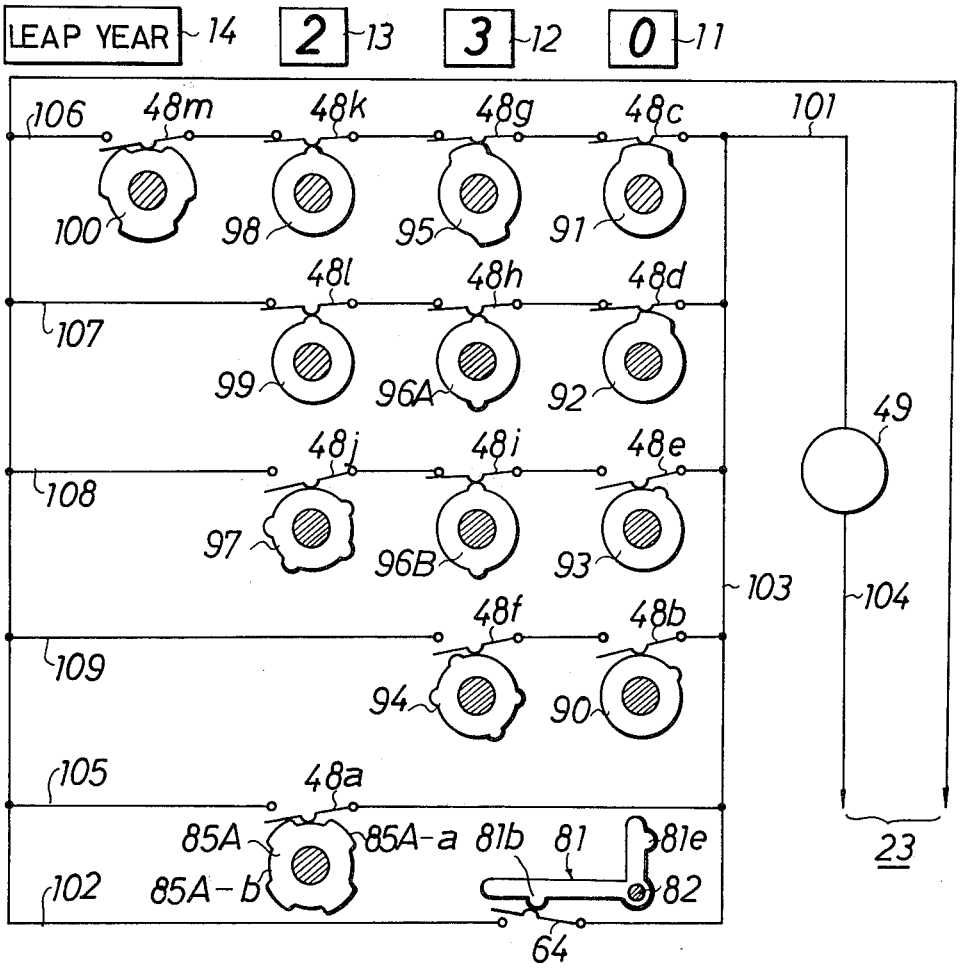
Figure 37:
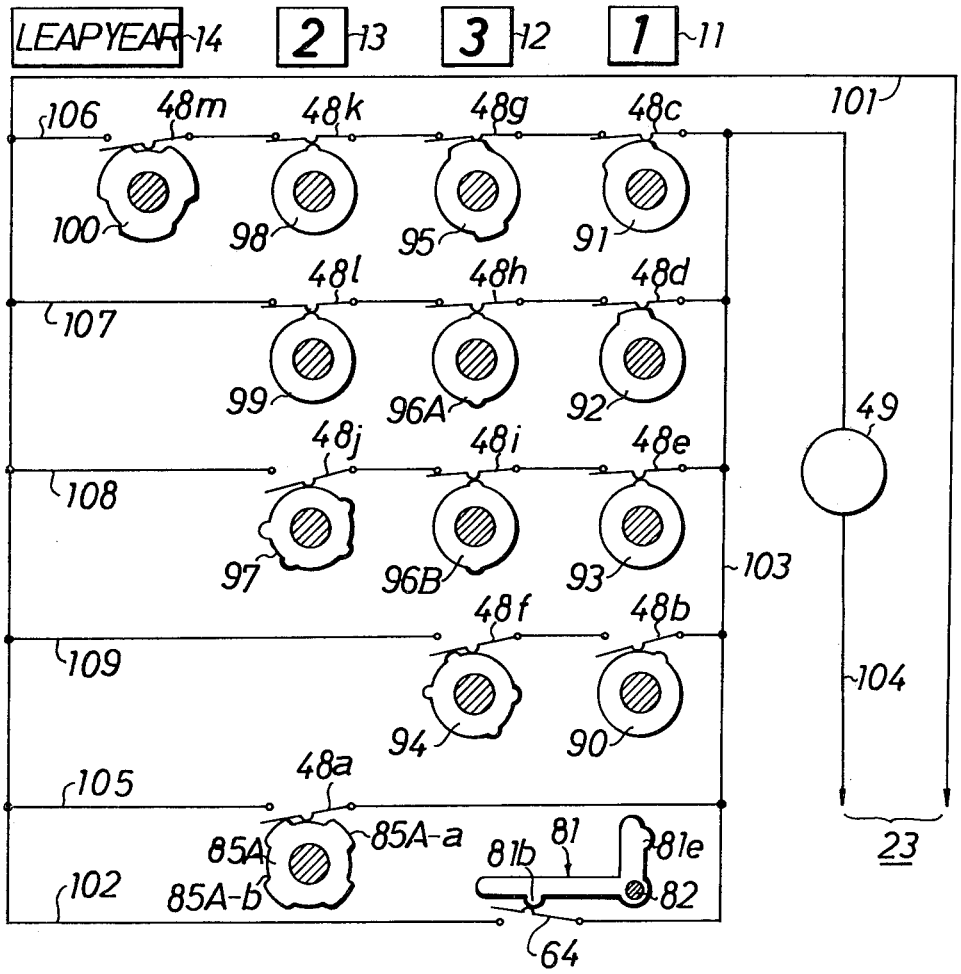

From 22nd day to 28th day of each month, branches each including the common year wire 106, the leap year wire 107, the short month wire 108 and the pass wire 109 are interrupted, so that a normal one day feed operation takes place for each change to 0 o'clock 00 minute a.m. From 28th to 31st day of a long month, the branches each including the common year wire 106, the leap year wire 107, the short month wire 108 and the path wire 109 are all interrupted, so that a normal one day feed operation takes place for each change to 0 o'clock 00 minutes a.m. during the interval from 28th to 31st day. Specifically, when a one day feed operation takes place to provide a display of 29th day and a change occurs from 11 o'clock 59 minutes p.m. of 29th day, the toothed portion 41*c* of the tens' feed, intermittent gear 41*b* associated with the unit's day display drum 41 meshes with the ten day feed pinion gear 73 for performing the carry operation, whereby both the unit's day display drum 41 and the tens' day display drum 42 rotate together to provide a display of 30th day. A normal one day feed operation takes place from 11 o'clock 59 minutes p.m. of 30th day to provide a display of 31st day (see FIG. 34). When a change occurs from 11 o'clock 59 minutes of 31st day of a long month to 0 o'clock 00 minute a.m., a normal one day feed operation takes place, and the toothed portion 41*d* of the tens' feed, intermittent gear 41*b* associated with the unit's day display drum 41 meshes with the ten day feed pinion gear 73 for performing the carry operation, whereby both the unit's day display drum 41 and the tens' day display drum 42 as well as the month display drum 43 rotate together to provide a display of 01st day of a next month. When a change from 11 o'clock 59 minutes p.m. of 30th day of each short month except February (that is, April, June, September and November) to 0 o'clock 00 minute a.m. occurs and a normal one day feed operation takes place to provide a display of 31st day, as shown in FIG. 35, the branch including the short month wire 108 is completed, permitting the drive motor 49 to continue its rotation to enable a pass operation, advancing one more day. Simultaneously, the carry operation of the month and day causes the display to be changed to 01st day of the next month. By passing the 11th day of each month (namely, a combination of 1B and 1*b*) and 21st day of each month (namely, a combination of 2B and 1*b*), the progress during a long month is from 1st day to 31st day in succession, followed by 1st day of the next month. At the end of February of a common year, when a normal one day feed operation takes place which becomes operative when changing from 11 o'clock 59 minutes p.m. of 28th day to 0 o'clock 00 minute a.m. of 29th day, the branch including the common year wire 106 is completed, causing the display of 29th, 30th and 31st days to be passed, thus producing a display of March 1st day. In a short month, the normal one day feed operation which becomes operative when changing from 11 o'clock 59 minutes p.m. of 30th day to 0 o'clock 00 minute a.m. causes the branch including the short month wire 108 to be completed, thereby causing a display of 31st day to be passed and changing the date to 1st day of the next month. When February 29 of a leap year is displayed and the normal one day feed operation occurs when changing from 11 o'clock 59 minutes p.m. to 0 o'clock 00 minute a.m. to change the date to February 30 of a leap year as shown in FIG. 36, the branch including the leap year wire 107 is completed to permit the drive motor 49 to continue its rotation, thereby advancing one more day to change the date to February 31 of the leap year as shown in FIG. 37. The branch including the leap year 107 is then still maintaining closed, so that the drive motor 49 further continues to rotate, advancing one more day and performing a carry operation from 31st day to provide a display of 1st day of the next month. Thereupon all of the branches each including the wires 106, 107, 108, 109, 105 and 102 are interrupted, whereby the drive motor 49 stops its motion with a display of 01 day of the next month.

In accordance with the invention, the branch including the common year wire 106 forms a memory circuit which causes the display of February 29th, 30th and 31st day of a common year to be passed. Also the branch including the leap year 106 forms another memory circuit which causes the display of February 30th and 31st day of a leap year to be passed. The branch including the short month wire 108 forms a memory circuit which causes the display of 31st day of each short month, namely, April, June, September and November to be passed. An additional circuit is formed whereby the overlapped display of 11th day of each month (a combination of 1B and 1*b*) and 21st day of each month (a combination of 2B and 1*b*) are passed. These memory circuits 106, 107, 108 and 109 include a plurality of switches which are operated by the respective groups of cams interlocked with the display drums for the year, month and days so that they provide a memory operation which repeats itself in a period of four years from one leap year to next. The unit's day display drum 41 carries eleven numerals at an equal interval in the sequence of 0, 1, 1, 2, 3, 4, 5, 6, 7, 8 and 9, while the tens' day display drum 42 carries six numerals at an equal interval in the sequence of 0, 1, 1, 2, 2 and 3. The unit's day display drum 41 and the tens' day display drum 42 are oriented relative to each other so that they provide a stating number of 30 and a carry is propagated to the tens' day display drum 42 at two occurrences when the numeral displayed by the unit's day display drum 41 changes from 9 to 0 and changes from 1 to 1. During an interval when the numeral displayed by the tens' day display drum 42 changes from 3 to 0, a carry is propagated to the month display drum 43 to change its display, while a carry is propageted to the year display drum 44 when the numral displayed by the month display drum 43 changes from 12 to 1. In this manner, the automatic calendar disclosed can be used in a calendar clock or watch, which requires only three times of adjustment during a prolonged period of 400 years.

While the above embodiment has been described in connection with a calendar clock in order to facilitate the understanding of the arrangement and operation of the automatic calendar according to the invention, it should be understood that the invention is by no means limited to such embodiment. By way of example, the invention can be preferably applied as a date printer which may be used in printing the date on a train ticket or the like. Such a date printer will be described below with reference to FIGS. 38 to 45.

Figure 38:
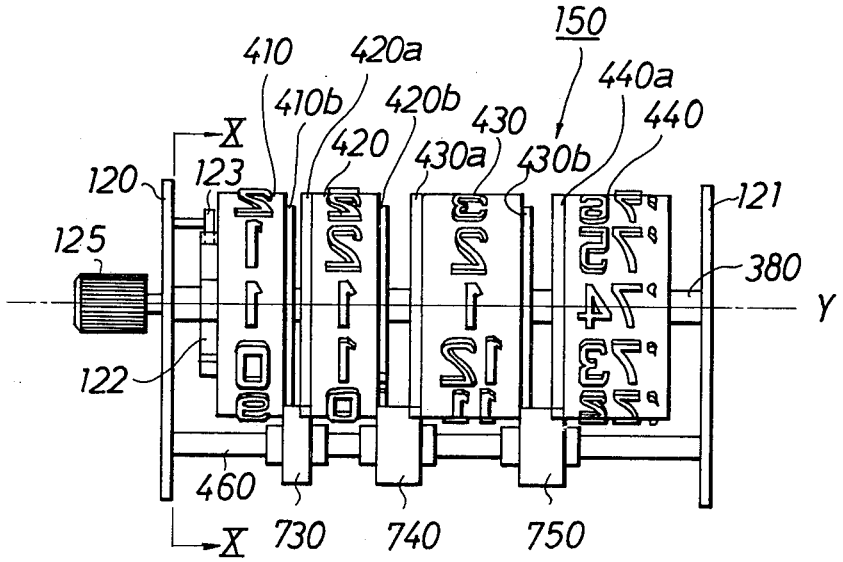
FIG. 38 is a schematic elevational view of the date printer according to another embodiment of the invention.
Figure 39:
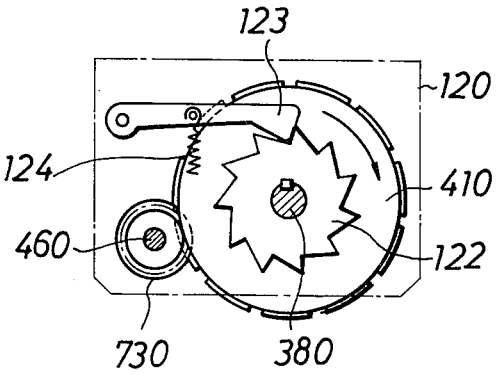
FIG. 39 is a view as viewed along the line X — X shown in FIG. 38.
Figure 40:
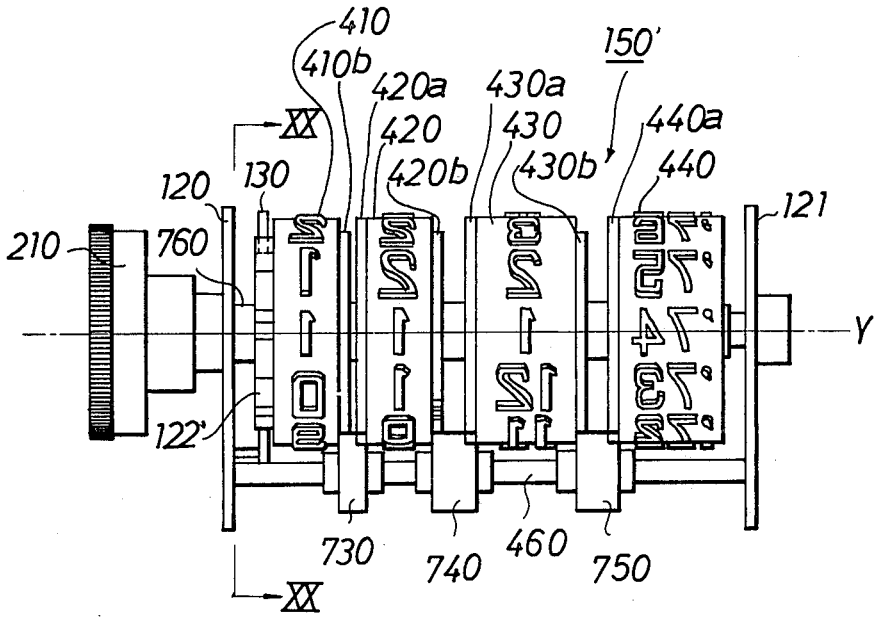
FIG. 40 is a schematic elevational view of the date printer according to a further embodiment of the invention.
Figure 41:
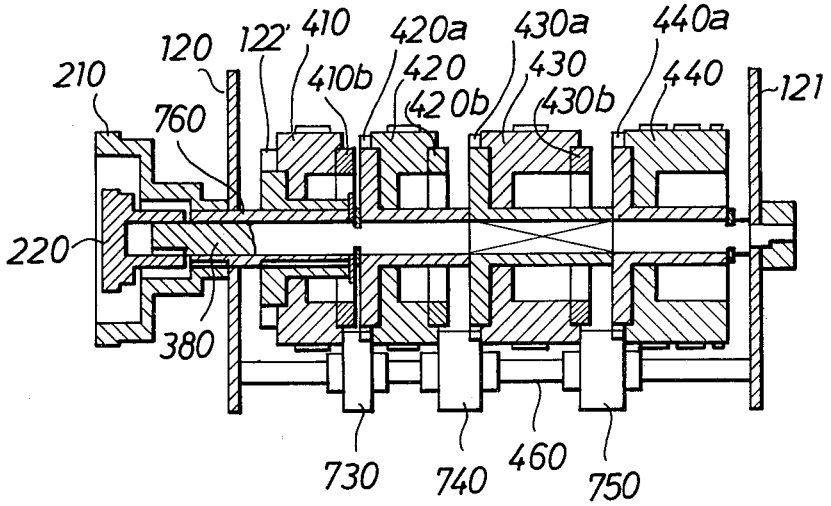
FIG. 41 is a cross section of the date printer shown in FIG. 40.
Figure 42:
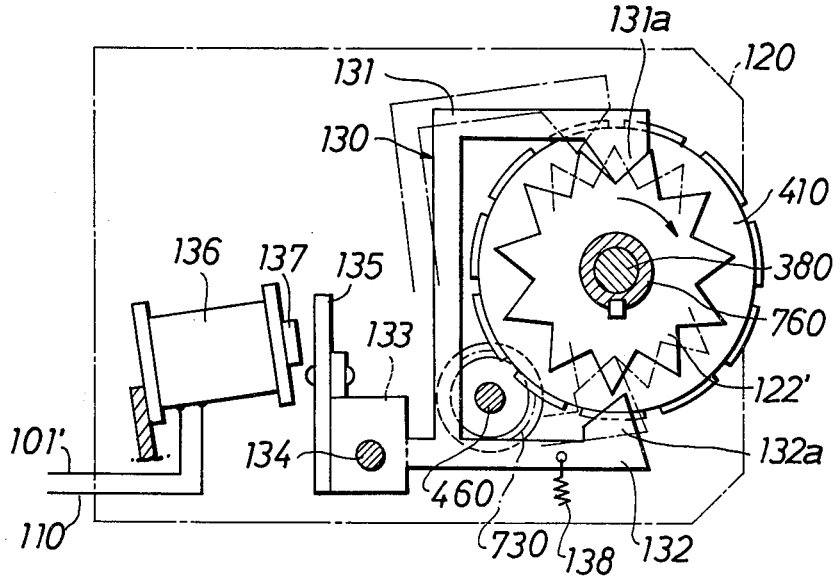
FIGS. 42 and 43 are views as viewed along the line XX — XX shown in FIG. 40.
Figure 43:
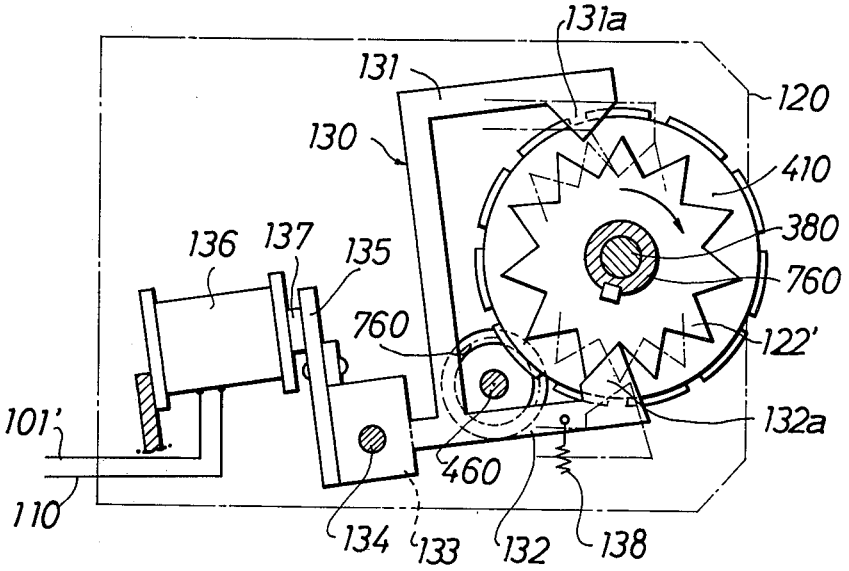
Figure 44:
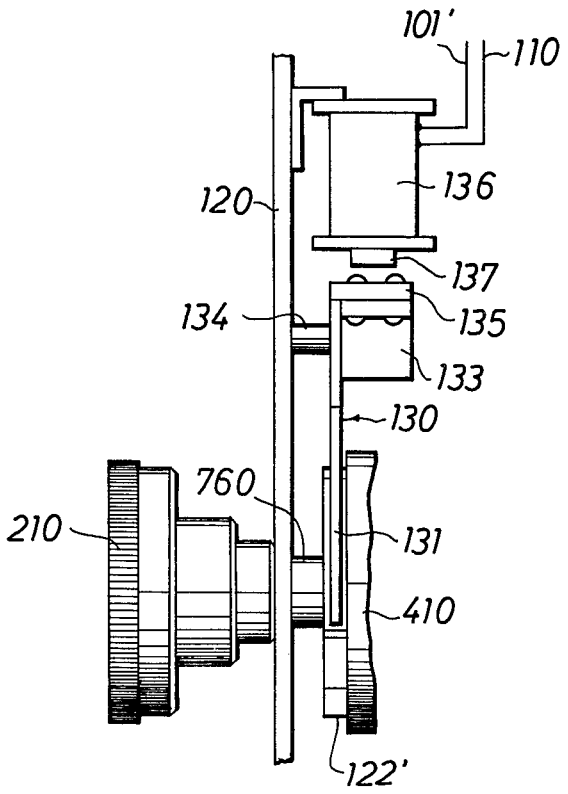
FIG. 44 is a top view.

Referring to FIGS. 38 and 39, the date printer includes a printing wheel assembly generally shown at 150, the assembly including a unit's day printing wheel 410, a tens' day printing wheel 420, a month printing wheel 430 and a year printing wheel 440. These printing wheels 410, 420, 430 and 440 are mounted on a shaft 380 which is in turn rotatably mounted on a pair of frames 120 and 121. The unit's day printing wheel 410 is fixedly mounted on the shaft 380, while other printing wheels 420, 430 and 440 are freely rotatable on the shaft 380. A carry pinion shaft 460 is supported in a pair of bearings (not shown) mounted on the frames 120 and 121, and rotatably mounted on the pinion shaft 460 are a ten day feed pinion gear 730 intermediate the unit's day printing wheel 410 and the tens' day printing wheel 420, a month feed pinion gear 740 intermediate the tens' day printing wheel 420 and the month printing wheel 430, and a year feed pinion gear 750 intermediate the month printing wheel 430 and the year printing wheel 440. On its one lateral side, the unit's day printing wheel 410 is integrally formed with a ratchet wheel 122 having eleven teeth, and a pawl 123 which is pivotally mounted on the frame 120 is normally urged by a tension spring 124 to engage the teeth on the ratchet wheel 122. One end of the shaft 380 extends externally of the frame 120 and is provided with a knob 125 at its free end, which can be rotated to cause an intermittent rotation of the unit's day printing wheel 410 in the direction indicated by an arrow in FIG. 39 by disengaging the meshing engagement between the ratchet wheel 122 and the pawl 123. On its outer periphery, the unit's day printing wheel 410 is provided with eleven types representing numerals in the sequence of 0, 1, 1, 2, 3, 4, 5, 6, 7, 8 and 9 and at an equal so as to present the respective types in such sequence at each end of the intermittent rotation mentioned above. Additionally, the unit's day printing wheel 410 is integrally provided with tens' feed intermittent gear **410*b* on its lateral side, which intermittent gear 410*b* corresponds to the tens' feed, intermittent gear 41*b* described previously in connection with the automatic calendar and includes a pair of toothed portions separated by hiatus. These toothed portions are disposed so that they mesh with the ten day feed pinion gear 730 to impart rotation thereto at two times during the rotation of the unit's day printing wheel 410 when the numeral type thereon changes from 9 to 0 and from 1 to 1 at the printing position Y, and the hiatus is located opposite to the ten day feed pinion gear 730 to disable the transmittion of rotation to the pinion gear 730 during the time other numeral types appear at the printing position Y. The ten day feed pinion gear 730 meshes with a ten day feed gear 420*a* integrally formed on the lateral side of the tens' day printing wheel 420 so as to rotate the latter through an angle of 30° at two times when the numeral type on the unit's day printing wheel 410 changes from 9 to 0 and from 1 to 1 at the printing position Y. On its outer periphery, the tens' day printing wheel 420 is provided with 12 types representing numerals in the sequence of 0, 1, 1, 2, 2, 3, 0, 1, 1, 2, 2 and 3 at an equal interval to present the respective numeral types at the printing position Y in the sequence of 0, 1, 1, 2, 2 and 3 at each end of the intermittent rotation through 30°. On its lateral side, the tens' day printing wheel 420 is integrally formed with a month feed, intermittent gear 420*b* which corresponds to the month feed intermittent gear 42*b* described previously in connection with the automatic calendar and thus include a pair of toothed portions separated by hiatus. The toothed portions on the tens' day printing wheel 420 mesh with the month feed pinion gear 740 to impart their rotation thereto when the numeral type thereon changes from 3 to 0 at the printing position Y, but the hiatus is located opposite to the month feed pinion gear 740 to prevent its rotation when other numerals appear at the printing position Y. The month feed pinion gear 740 meshes with a month feed gear 430*a* integrally formed on the lateral side of the month printing wheel 430 so as to rotate the latter through 30° during the time the numeral type on the ten's day printing wheel 420 changes from 3 to 0 at the printing position Y. On its outer periphery, the month printing wheel 430 is provided with 12 numeral types in the sequence of from 1 to 12 and at an equal interval so as to present such numeral types in this sequence at the printing position Y at each end of the intermittent rotation through 30°. On its lateral side, the month printing wheel 430 is integrally formed with a year feed intermittent gear 430*b* which corresponds to the year feed intermittent gear 43*b* previously described in connection with the automatic calendar and includes a toothed portion and a hiatus in the remaining portion. During an interval the numeral type on the month printing wheel 430 changes from 12 to 1 at the printing position Y, the toothed portion on the intermittent gear 430*b* meshes with the year feed pinion gear 750 to impart rotation thereto, but when other numeral types appear at the printing position Y, the hiatus of the intermittent gear 430*b* is located opposite to the pinion gear 750 to prevent its rotation. The year feed gear 750 meshes with a year feed gear 440*a* which is integrally formed on the lateral side of the year printing wheel 440 to rotate the latter through a required angle during the time the numeral type on the month printing wheel 430 changes from 12 to 1 at the printing position Y, thereby enabling a type representing the following year to appear at the printing position Y. In the present example, the year printing wheel 440** is provided with twelve numeral types at an equal interval and thus requires an intermittent rotation of 30°.

The progress of date provided by the combination of the unit's day printing wheel 410 and the tens' day printing wheel 420 will be described below. In the description to follow, it is assumed that the combination of the printing wheels 410 and 420 starts from 30 as in the description of the automatic calendar.

The unit's day printing wheel 410 rotates intermittently in an angular increment of 1/11 revolution or 360°/11, while the tens' day printing wheel 420 rotates intermittently in an angular increment of 1/12 or 30°. In addition, the tens' day printing wheel is also subject to an intermittent rotation when the numeral type on the unit's day printing wheel 410 changes from 9 to 0 and from 1 to 1 at the printing position Y. The progress of date which occurs as a result of the intermittent rotation of the unit's day printing wheel 410 is as follows: 01 → 02 → 03 → 04 → 05 → 06 → 07 → 08 → 09 → 10 → 11 → 11 → 12 → 13 → 14 → 15 → 16 → 17 → 18 → 19 → 20 → 21 → 21 → 22 → 23 → 24 → 25 → 26 → 27 → 28 → 29 → 30 → 31, thus completing one circulation in 33 days. By passing two of these days, namely 11th day and 21st day which occurs in an overlapped manner, the types representing a date for 31 days of one month can appear successively at the printing position Y.

A carry operation for the day takes place by turning the knob 125 mounted on the free end of the calendar shaft 380 so as to impart an intermittent rotation of 1/11 revolution or 360°/11 to the unit's day printing wheel 410. Specifically, at two times when the numeral type on the unit's day printing wheel 410 changes from 9 to 0 and 1 to 1 at the printing position Y, a carry operation is performed by rotating the tens' day printing wheel 420 through the tens' day feed pinion gear 730. At the first occurrence of 11th and 21st day which appear in an overlapped manner during 33 days of one circulation, the knob 125 is additionally turned to provide a rotation of the unit's day printing wheel 410 through 1/11 revolution or 360°/11 to cause the rotation of the tens' day printing wheel 420 also, thereby allowing the secondly occurring 11th and 21st day to appear.

In this manner, a date printer is provided according to the invention which permits a change from the last day of a month to the first day of the next month in a simple manner by a circulating operation. While the above embodiment of the date printer has been described as a mannually operated date printer, it should be obvious that such date printer may be combined with the clock described in connection with the automatic calendar to provide an automatic date printer. Such an embodiment is illustrated in FIGS. 40 to 45. It should be borne in mind that the unit's day, tens' day, month and year printing wheels used in the embodiment shown in FIGS. 40 to 45 are similarly constructed as in the previous embodiment, and therefore corresponding elements are designated by like numerals without accompanying a description therefor.

Referring to FIGS. 40 to 45, the unit's day printing wheel 410 is mounted on a sleeve-shaped date adjusting shaft 760 which is rotatably fitted on the main shaft 380, while the month printing wheel 430 is secured to the main shaft 380. A unit's day adjusting knob 210 is fixed to the end of the date adjusting shaft 760 which projects externally of the frame 120. A month adjusting knob 220 is fixedly mounted on the end of the main shaft 380 which projects externally of the frame and is reletively rotatable with respect to the unit's day adjusting knob 210.

Figure 45:
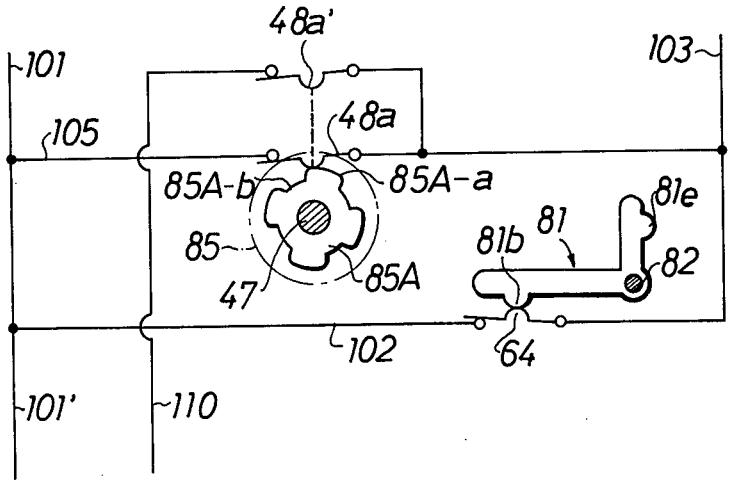
FIG. 45 is a circuit diagram of a modification of part of the calendar memory assembly.

On its one lateral side, the unit's day printing wheel 410 is integrally formed with a feed gear 122' having eleven teeth, which are associated with a feed member 130 pivotally mounted on the frame 120. As will be apparent from FIGS. 42 and 43, the feed member 130 is channel shaped in section so as to have a pair of feed arms 131, 132, and is integrally mounted on a rotatable body 133 which is in turn pivotally mounted on a shaft 134 mounted on the frame 120. The rotatable body 133 is provided with an attracting member 135 which is located opposite to the armature 137 of a solenoid 136 which is fixedly mounted on the frame 120. Solenoid 136 is connected in a solenoid energizing circuit 110 of the power source 101' and is adapted to provide an attraction or release operation in response to an on and off operation of an output signal switch **48*a'* shown in FIG. 45. At their free ends, the feed arms 131 and 132 are each provided with a feeding tooth 131*a*, 132*a*, which are adapted to mesh with the feed gear 122' integral with the unit's day printing wheel 410. The feed arm 132 is urged by a spring member 138 so as to cause the feed member 130 to rotate clockwise, as viewed in FIG. 42, about the shaft 134. When the solenoid 136 is deenergized, the feeding tooth 131*a* on the feed arm 131 normally meshes with the feed gear 122' to prevent the rotation of the unit's day printing wheel 410 which is integral with the feed gear 122'. However, when the rotatable body 133 is rotated counter-clockwise, as viewed in FIG. 42, against the resilience of the spring member 138, the feeding tooth 132*a* feeds the feed gear 122' by one-half pitch. When the rotatably body 133 rotates clockwise, as viewed in FIG. 43, the feed gear 122' is fed by another one-half pitch, so that as a result of one reciprocatory rotation of the rotatable body 133, the feed gear 122' is fed substantially by one pitch in the direction indicated by an arrow. Since the unit's day printing wheel 410 rotates together with the feed gear 122', the unit's day printing wheel 410 is intermittently rotated through 1/11 revolution or 360°/11 for each reciprocatory rotation of the rotatable body 133. The reciprocatory rotation of the rotatable body 133 is achieved by the energization and deenergization of the solenoid 136, which is controlled by turning on and off of the output signal switch 48*a'* (see FIG. 45), which in turn operates by interlocking with the keep switch 48*a* described previously in connection with the automatic calendar. The clock which is to be used with the date printer 150' according to the present embodiment is constructed in the similar manner as described in connection with the automatic calendar. As described, the keep cam gear 85 loosely fitted on the memory cam shaft 47 is integrally provided with the keep cam 85A on its lateral side, and meshes with the relay gear 51 to have the rotation of the drive motor 49 of the calendar transmitted thereto through the relay gear 51. It rotates at the same rate as the date operating wheel 40, and commences its rotation, upon energization of the drive motor 49, from a rest position in which the intermittent gear 40*b* formed integrally on the lateral side of the date operating wheel 40 is about to mesh with the one day feed pinion gear 72 so that the keep 85A maintains the switch on during the time the intermittent gear 40*b* meshes with the one day feed pinion gear 72 to rotate the date operating wheel 40, one day feed pinion gear 72 and unit's day display drum 41 through respective angles corresponding to one day. In FIG. 45, the output signal switch 48' is connected in a branch circuit from the keep circuit 105, and is turned on and off in interlocked relationship with the keep switch 48***a* which is turned on and off by the keep cam 85A.

The progress of date afforded by the combination of the unit's day printing wheel 410 and the tens' day printing wheel 420 is essentially the same in this embodiment as described before in connection with the previous embodiment, and therefore will not be repeated herein.

The carry operation for the day is effected by turning on the keep switch 48*a* upon rotation of the drive motor 49, and consequently turning on the output signal switch 48*a'* to energize the solenoid 136. At this time, the attracting body 135 provided on the rotatable body 133 is attracted to the armature 137 of the solenoid 136, whereby the feed member 130 rotates counter-clockwise, as viewed in FIG. 42, together with the rotatable body 133, causing a meshing engagement of the feeding tooth 132*a* with the feed gear 122' to feed the latter by one-half pitch. When the keep cam 85A has rotated to turn off the keep switch 48*a*, the output signal switch 48*a'* is also turned off to deenergize the solenoid 136, thus releasing the attraction applied to the attracting body 135. Thereupon, the feed member 130 rotates clockwise, as viewed in FIG. 43, together with the rotatable body 133 under the resilience of the spring 138 to cause a meshing engagement of the feeding tooth 131*a* with the feed gear 122' to feed it by one-half pitch. In this manner, each time the keep switch 48*a* of the calendar is turned on and off, the output signal switch 48' is turned on and off, causing one reciprocately rotation of the feed member 130 to permit the feed gear 122' to be fed by one pitch. As a result, an intermittent rotation of 1/11 revolution or 360°/11 is imparted to the unit's day printing wheel 410, and a carry operation takes place to rotate the tens' day printing wheel 420 through the tens' day feed pinion gear 730 at two times when the numeral type on the unit's day printing wheel 410 changes from 9 to 0 and from 1 to 1 at the printing position Y. It will be appreciated from the description given in connection with the automatic calendar that a carry operation takes place automatically at the second occurrence of 11th and 21st day which occur in an overlapped manner during 33 days of one dirculation.

It should be also apparent that the adjustment of day, month and year can be simply achieved as described, by turning the unit's day adjusting knob 210 and the month adjusting knob 220.

While certain embodiments of the invention have been shown and described above, it should be apparent to those skilled in the art that many other modifications and changes may be made without departing from the true spirit and scope of the invention defined in the appended claims.

What is claimed is:

1. A calendar comprising a units display drum having a periphery and displaying a plurality of spaced numerals in the sequence 0,1,1,2,3,4,5,6,7,8, and 9 at equal intervals on the periphery of the units display drum, a tens display drum having a periphery and displaying a plurality of spaced numerals in the sequence 0, 1, 1, 2, 2, and 3 at equal intervals on the periphery of the tens display drum, a calendar main shaft for concentrically supporting the units display drum and the ten's display drum adjacent each other, support means for supporting said shaft, said support means having index means adjacent said drums for indicating a single numeral on each of said drums, stepping means coupling the units display drum to the tens display drum for advancing the tens display drum relative to the index means once when the numeral of the units display drum appearing at the index means changes from 9 to 0 once when the numeral of the units display drum appearing at the index means changes from 1 to 1, and rotating means for rotating the units display drum to move a numeral past the index means each day so as to display the days of a month in sequence.

2. A calendar according to claim 1, in which said rotating means include control means for rotating the units drum twice on the 11th and 21st day of each month.

3. A calendar according to claim 2, wherein said rotating means includes a rotary drive coupled to said drum, said control means including a plurality of cam gears interlocked with the respective display drums and having cams integrally formed thereon, and calendar memory switch means including a plurality of switches operated by the cams for controlling the drive to rotate the days display drum depending upon the length of a month.

4. A calendar according to claim 1, said rotating means including a date adjusting shaft mounted on and rotatable relative to the calendar main shaft and a day adjusting member mounted on the date adjusting shaft, said units display drum being secured to the date adjusting shaft and said tens' day display drum being secured to the calendar shaft so that adjustment of the date adjusting shaft adjusts the display of day presented by the respective display drums.

5. A calendar according to claim 4 further including a month display drum mounted on the calender shaft, a year display drum mounted on the calendar shaft, and a year and month adjusting member mounted on the calendar shaft, second stepping means interposed between and interconnecting said month and year drums so that adjustment of the year and month adjusting member permits adjustment of the display of year and month presented by the year and month display drum.

* * * * *